US007202607B2

(12) United States Patent
Kazar et al.

(10) Patent No.: US 7,202,607 B2
(45) Date of Patent: Apr. 10, 2007

(54) YEAR-ROUND DECORATIVE LIGHTS WITH TIME-MULTIPLEXED ILLUMINATION OF INTERLEAVED SETS OF COLOR-CONTROLLABLE LEDS

(75) Inventors: Dennis Michael Kazar, Austin, TX (US); John Jeffery Oskorep, Chicago, IL (US)

(73) Assignee: Year-Round Creations, LLC, Chicago, IL (US)

( * ) Notice: Subject to any disclaimer, the term of this patent is extended or adjusted under 35 U.S.C. 154(b) by 118 days.

(21) Appl. No.: 10/763,658

(22) Filed: Jan. 23, 2004

(65) Prior Publication Data

US 2005/0162851 A1 Jul. 28, 2005

(51) Int. Cl.
*F21S 4/00* (2006.01)
*H05B 37/00* (2006.01)

(52) U.S. Cl. ..... 315/185 S; 315/312

(58) Field of Classification Search ..... 315/291–295, 315/312, 316, 320, 200 A, 185 S, 185 R; 362/231, 252, 248, 800
See application file for complete search history.

(56) References Cited

U.S. PATENT DOCUMENTS

| | | | | |
|---|---|---|---|---|
| 3,623,066 | A | 11/1971 | Norris | 345/73 |
| 3,789,211 | A | 1/1974 | Kramer | 362/231 |
| 3,946,244 | A | 3/1976 | Davis, Jr. | 307/31 |
| 4,153,860 | A | 5/1979 | Vonick | 473/201 |
| 4,215,277 | A | 7/1980 | Weiner et al. | 307/41 |
| 4,682,079 | A | 7/1987 | Sanders et al. | 315/186 |
| 4,780,621 | A | 10/1988 | Bartleucci et al. | 307/11 |
| 4,890,000 | A | 12/1989 | Chou | 307/36 |
| 5,008,595 | A | 4/1991 | Kazar | 315/178 |
| 5,245,519 | A | 9/1993 | Openiano | 362/252 |
| 5,300,864 | A | 4/1994 | Allen, Jr. | 315/314 |

(Continued)

FOREIGN PATENT DOCUMENTS

| | | |
|---|---|---|
| WO | WO 99/10867 | 3/1999 |

(Continued)

OTHER PUBLICATIONS

Guerrero, Lucio; "End the Xmas light fight: Just leave them up"; Red Streak; Tuesday, Dec. 2, 2003; p. 6, vol. 22, No. 22, Chicago Sun-Times Inc,; Chicago, IL, USA.

(Continued)

*Primary Examiner*—Wilson Lee
(74) *Attorney, Agent, or Firm*—John J. Oskorep, Esq.

(57) ABSTRACT

A decorative lighting apparatus provides user-selectable color schemes corresponding to several holidays and other occasions for year-round use. In one illustrative example, the decorative lighting apparatus includes control circuitry which has a plurality of color-control outputs for coupling to color-control terminals of each one of a plurality of color-controllable lights along a decorative light strand. The control circuitry is operative to illuminate the color-controllable lights with any given color scheme by repeatedly time-multiplexing color-control signals at the color-control outputs to different interleaved sets of color-controllable lights along the decorative light strand. Each color-controllable light is a Red-Green-Blue (RGB) Light-Emitting Diode (LED). Preferably, the time-multiplexing rate is sufficient such that the RGB LEDs appear to be simultaneously illuminated along the strand (e.g. 32 Hertz or greater). Advantageously, this low-cost implementation reduces the number of wires required along the decorative light strand without sacrificing versatility.

21 Claims, 12 Drawing Sheets

U.S. PATENT DOCUMENTS

| | | | | |
|---|---|---|---|---|
| 5,359,506 | A | 10/1994 | Koleno | 362/248 |
| 5,629,587 | A | 5/1997 | Gray et al. | 315/292 |
| 5,747,940 | A | 5/1998 | Openiano | 315/185 S |
| 5,749,646 | A | 5/1998 | Brittell | 362/231 |
| 5,944,408 | A | 8/1999 | Tong et al. | 315/252 |
| 5,980,062 | A | 11/1999 | Bell | 315/249 |
| 6,015,218 | A | 1/2000 | Snell | 315/249 |
| 6,050,701 | A | 4/2000 | Stone | 362/249 |
| 6,150,774 | A | 11/2000 | Mueller et al. | 315/291 |
| 6,299,338 | B1 | 10/2001 | Levinson et al. | 362/559 |
| 6,309,086 | B1 | 10/2001 | Tomlinson | 315/249 |
| 6,384,545 | B1 | 5/2002 | Lau | 315/292 |
| 6,424,096 | B1 | 7/2002 | Lowe et al. | 315/185 R |
| 6,577,080 | B2 | 6/2003 | Lys et al. | 315/362 |
| 6,608,453 | B2 | 8/2003 | Morgan et al. | 315/312 |
| 6,686,701 | B1 | 2/2004 | Fullarton | 315/185 S |
| 6,690,120 | B2 | 2/2004 | Oskorep et al. | 315/178 |

FOREIGN PATENT DOCUMENTS

| | | |
|---|---|---|
| WO | WO 99/31560 | 6/1999 |
| WO | WO 02/069306 A2 | 9/2002 |
| WO | WO 02/098182 A2 | 12/2002 |
| WO | WO 03/026358 A1 | 3/2003 |
| WO | WO 03/055273 A2 | 7/2003 |
| WO | WO 03/067934 | 8/2003 |

OTHER PUBLICATIONS

Guerrero, Lucio; "Lights go up, never come down"; Chicago Sun-Times; Wednesday Dec. 3, 2003; p. 14, vol. 56, No. 258, Chicago Sun-Times Inc.; Chicago, IL USA.

Mullins, Michelle; "No-fuss lighting"; Daily Southtowner; Thursday, Dec. 4, 2003; pp. B1 & B6, vol. 26, No. 282, Midwest Suburban Publishing; Chicago, IL, USA.

U.S. Appl. No. 10/758,143; Kazar et al; Etitled "Year-Round Decorative Lights With Addressable Color-Controllable Nodes For Selectable Holdiay Color Schemes".

U.S. Appl. No. 10/678,934; Oskorep et al; Entitled "Decorative LightsWith At Least One Commonly Controlled Set Of Color-Controllable Multi-Color LEDS for Selectable Holiday Color Schemes".

U.S. Appl. No. 10/731,975; Oskorep et al; Entitled "Year-Round Decorative Lights With Selectable Holiday Color Schemes".

Select pages from www.colorkinetics.com of Color Kinetics, Inc.; published at least as of Dec. 17, 2003.

CONTROLLER
102
112
202
SWITCH MECHANISM
S01
S02
P01
P08
INPUTS
216
MEMORY
E1 OUT
E2 OUT
E3 OUT
E4 OUT
PWM1 OUT
PWM2 OUT
PWM3 OUT
DAC1 OUT
DAC2 OUT
DAC3 OUT
CC1
CC2
CC3
V+
Driver 1
Driver 2
Driver 3
Driver 4
Driver R
Driver G
Driver B
114
116
118
120
122
124
126
128
D
S
S1
S2
S4
S4
IR
IG
IB
SET SELECTION OUTPUTS/LINES 106
208
210
212
214
LIGHT SET S1
LIGHT SET S2
LIGHT SET S3
LIGHT SET S4
DAC1
DAC2
DAC3
104
132
134
136
Color-control OUTPUTS/LINES 108
D
CC
I
130
204

104
106
L1
L2
L3
L4
806
808
810
812
814
816
R
G
B
SET SELECTION LINES 706
102
Color-control LINES 708
IR
IG
IB
114, 116, 118, etc.
4 channel / 7 wire
ALTERNATIVE 114, 116, 118, etc.
2 channel / 5 wire

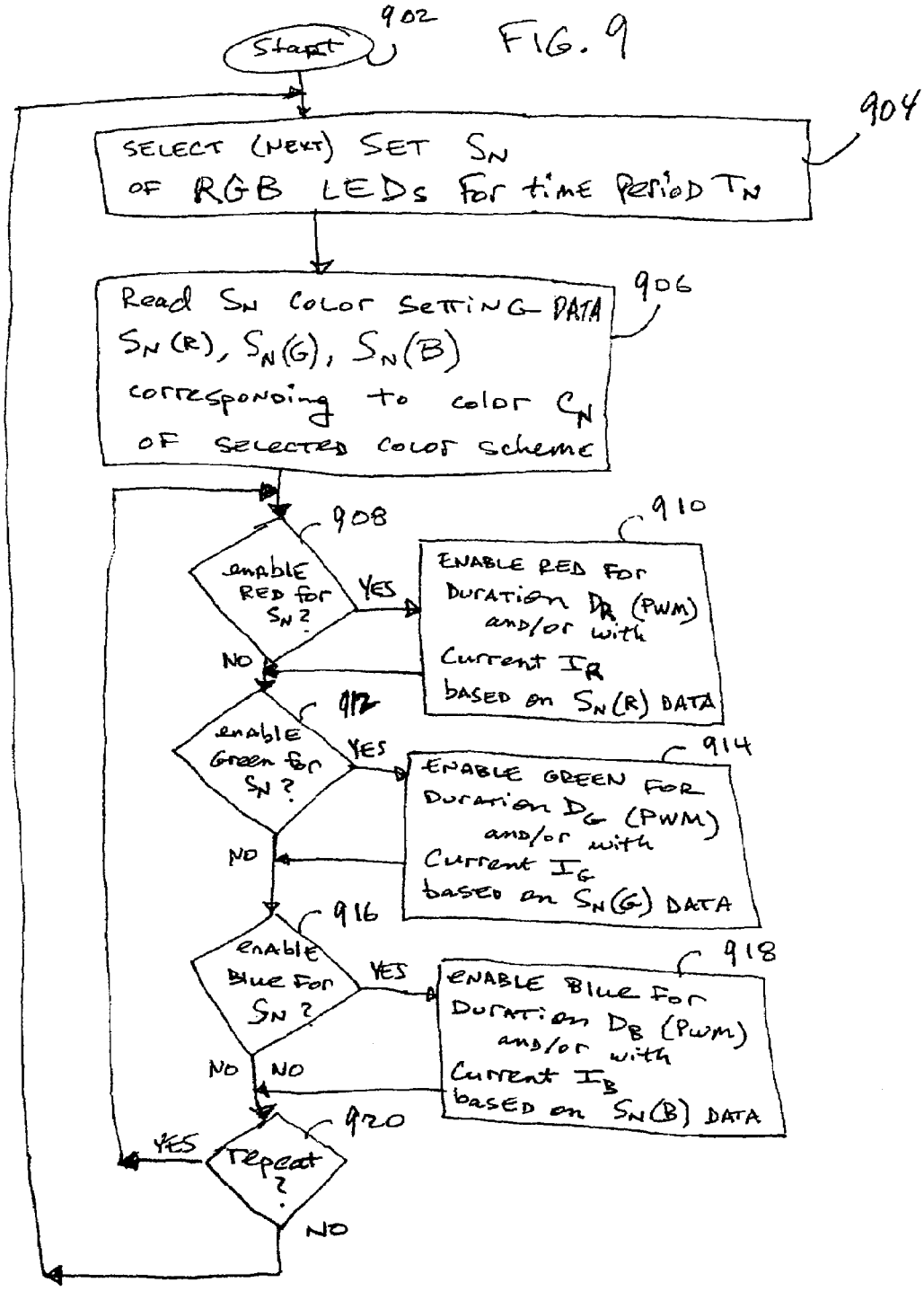
FIG. 9
902
Start
904
SELECT (NEXT) SET $S_N$ OF RGB LEDs for time period $T_N$
906
Read $S_N$ color setting DATA $S_N(R)$, $S_N(G)$, $S_N(B)$ corresponding to color $C_N$ of selected color scheme
908
enable RED for $S_N$?
YES
NO
910
ENABLE RED for Duration $D_R$ (PWM) and/or with Current $I_R$ based on $S_N(R)$ DATA
912
enable Green for $S_N$?
YES
NO
914
ENABLE GREEN for Duration $D_G$ (PWM) and/or with Current $I_G$ based on $S_N(G)$ DATA
916
enable Blue for $S_N$?
YES
NO
918
ENABLE Blue for Duration $D_B$ (PWM) and/or with Current $I_B$ based on $S_N(B)$ DATA
920
Repeat?
YES
NO

T1
T2
T3
T4

S1
S2
S3
S4
lines 106
TON
TOFF
C1= Orange
C2= Orange
C3= Orange
C4= Orange

IR
IG
IB
lines 108
C1= RED
C2= Orange
C3= Blue
C4= Purple

C1= RED
C2= Green
C3= RED
C4= Green

C1= RED
C2= WHITE
C3= Blue
C4= OFF

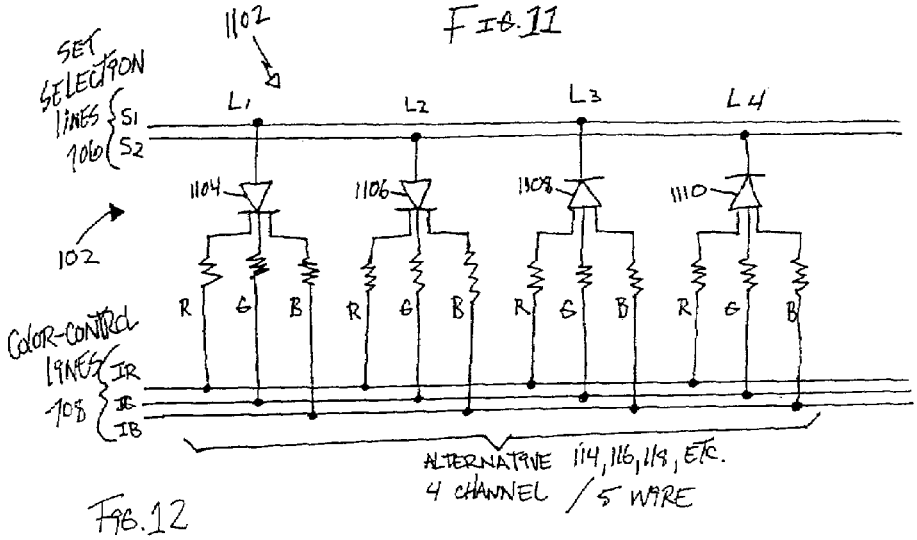
FIG. 12
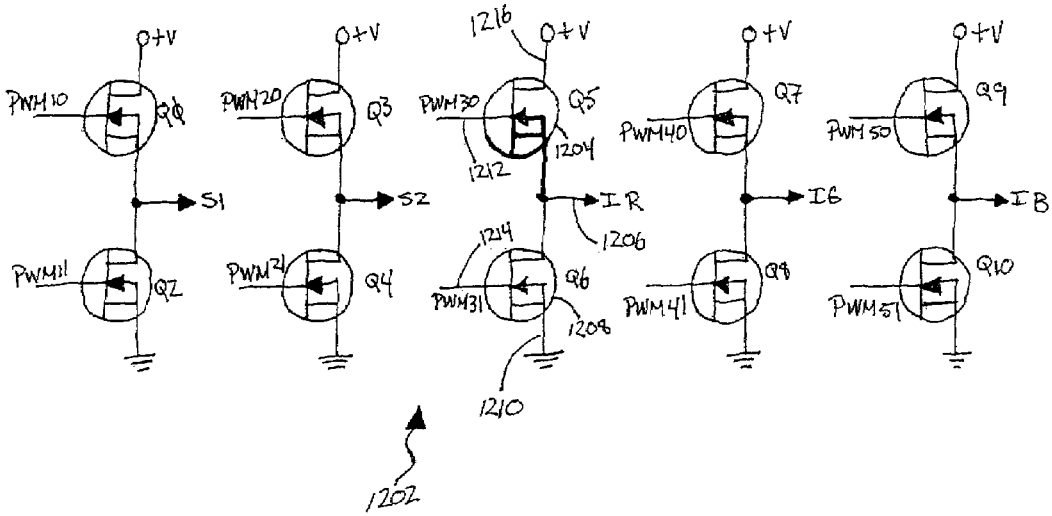

YEAR-ROUND DECORATIVE LIGHTS WITH TIME-MULTIPLEXED ILLUMINATION OF INTERLEAVED SETS OF COLOR-CONTROLLABLE LEDS

BACKGROUND

1. Field of the Invention

The present invention relates generally to decorative lights such as decorative holiday lights (e.g. Christmas lights), and more particularly to decorative light strands with user-selectable color schemes corresponding to several holidays for year-round use, having with interleaved sets of color-controllable light-emitting diodes (LEDs) which are illuminated in a time-multiplexed fashion.

2. Description of the Related Art

Conventional decorative lights are typically fixed in color and celebratory purpose. One type of conventional light strand includes a plurality of lights which have the same single color (e.g. all white or all red). Another conventional light strand includes a plurality of lights which are multi-color (e.g. red, green, white, blue, and yellow) and lit all at the same time. Many of these lights are suitably colored for the Christmas holidays; e.g. solid red and green, although other multi-color combinations are popular. Some light strands provide for a "flashing" or "blinking" of lights in a random or set fashion. An end-user of Christmas lights typically hangs one or more light strands for the holiday (indoors or outdoors), and takes them down and puts them into storage after the holiday is over.

Holidays other than Christmas are celebrated as well, although light strands for these occasions are difficult to find if they even exist at all. For Independence Day and Memorial Day, the color combination of red, white, and blue is popular. For Hanukkah, the colors of blue and gold are popular. For Halloween, the color combination of orange and yellow is popular. For these and other celebrated holidays, an individual often purchases different decorations just before the holiday and hangs them up. For other occasions, such as parties, birthdays, anniversaries, showers, graduations, etc., one typically has to purchase other suitable decorations and decorate with them. These decorative items are hung up for the occasion and thereafter taken down.

Prior art related to the present application includes a Christmas light strand (manufacturer unknown) which has a button switch for providing eight (8) different lighting variations. The light strand has four (4) different colored lights in the following repeated sequence: red, green, orange, and blue. The lighting variations are described as follows: 1—"COMBINATION; 2—"IN WAVES"; 3—"TWINKLE/FLASH"; 4—"SLO-GLO"; 5—"SEQUENTIAL"; 6—"SLOW FADE"; 7—"CHASING/FLASH"; AND 8—"STEADY ON". For the $2^{nd}$, $3^{rd}$, $5^{th}$, and $7^{th}$ settings, somewhat random flashing of all of the colors are provided in subtle variations. For the $4^{th}$ and $6^{th}$ settings, fading in and out of all of the colors (in sequence and simultaneously, respectively) are provided. All colors are lit solid in the $8^{th}$ setting. Finally, the $1^{st}$ setting sequences through the $1^{st}$ through $7^{th}$ settings. This light strand and its settings are designed solely for Christmas; no different color schemes or holiday schemes are provided. The above-described light strand is representative of such user-controllable time-sequenced lights which are suitable for Christmas or commercial applications.

The present invention relates to a "year-round" decorative light strand which provides for different color schemes which are selectable by the end user with use of a decorating selector/switch. The different color schemes include U.S. holiday color schemes for year-round usage. Patent applications related to such a year-round decorative light strand include U.S. Patent Application Publication US2003/0210547 filed on May $10^{th}$ 2002 entitled "Year-Round Decorative Lights With Selectable Holiday Color Schemes"; and U.S. patent application Ser. No. 10,678,934 filed on Oct. $3^{rd}$ 2003 entitled "Decorative Lights With At Least One Commonly Controlled Set Of Color-Controllable Multi-Color LEDs For Selectable Holiday Color Schemes".

In a color-scheme-controllable light strand, the number of wired lines along the light strand may be relatively large depending on the specific implementation. In addition, there may be unattractive non-lit bulbs along the light strand in at least some selected color schemes. Further, there may be a consumer expectation that the light strand have an increased life of use based on the year-round color scheme features that it provides. Finally, although such a light strand provides for different color schemes, there may be limitations on which particular colors are utilized (e.g. uncommon colors such as purple or pink may not be provided).

Accordingly, what is needed is a decorative lighting apparatus which overcomes the deficiencies of the prior art.

SUMMARY

A decorative lighting apparatus provides user-selectable color schemes corresponding to several holidays and other occasions for year-round use. In one example of the present invention, the decorative lighting apparatus includes control circuitry which has a plurality of color-control outputs for coupling to color-control terminals of each one of a plurality of color-controllable lights along a decorative light strand. The control circuitry is operative to illuminate the color-controllable lights with any given color scheme by repeatedly time-multiplexing color-control signals at the color-control outputs to different sets of color-controllable lights along the decorative light strand. Preferably, the color-controllable lights are Red-Green-Blue (RGB) Light-Emitting Diodes (LEDs). Also preferably, the time-multiplexing rate is sufficient such that the RGB LEDs appear to be simultaneously illuminated along the strand (e.g. 32 Hertz or greater).

Advantageously, the decorative light strand may be hung permanently and utilized year-round for major holidays and other suitable occasions. In a color-scheme-controllable light strand, the use of RGB LEDs as described provides for flexibility in the choice of colors through use of color setting and mixing techniques (e.g. pulse width modulation and/or current control), reduces the number of (or eliminates) non-lit bulbs for at least some color schemes, and provides the light strand with a long-life which is especially desirable in a year-round application. The time-multiplexed control over the color-controllable RGB LEDs as described reduces the number of wired lines to the lights, which is particularly advantageous in a decorative light strand.

BRIEF DESCRIPTION OF THE DRAWINGS

FIG. 9 is a flowchart which describes a method of providing time-multiplexed color-control in the decorative lighting apparatus in connection with the present invention;

FIG. 11 is a schematic diagram which shows another example of a configuration of color-controllable lights (e.g. RGB LEDs) along the decorative light strand;

FIG. 12 is a diagram of switching/driver circuits which may be utilized with the layout of color-controllable lights of FIG. 11;

DETAILED DESCRIPTION OF THE PREFERRED EMBODIMENTS

A decorative lighting apparatus provides user-selectable color schemes corresponding to several holidays and other occasions for year-round use. In one example of the present invention, the decorative lighting apparatus includes control circuitry which has a plurality of color-control outputs for coupling to color-control terminals of each one of a plurality of color-controllable lights along a decorative light strand. The control circuitry is operative to illuminate the color-controllable lights with any given color scheme by repeatedly time-multiplexing color-control signals at the color-control outputs to different interleaved sets of color-controllable lights along the decorative light strand. Preferably, the color-controllable lights include Red-Green-Blue (RGB) Light-Emitting Diodes (LEDs). Advantageously, this low-cost implementation reduces the number of wires required along the decorative light strand without sacrificing versatility.

Figure 1:
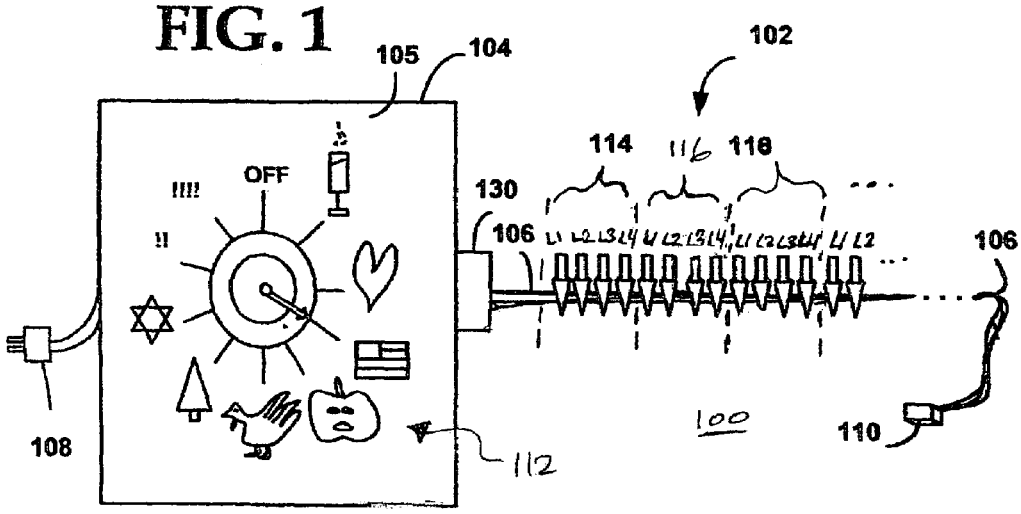
FIG. 1 is an illustration of a decorative lighting apparatus which includes a representative arrangement of color-controllable lights along a decorative light strand as well as a decorating selector.

FIG. 1 is an illustration of a decorative lighting apparatus 100 which includes an arrangement of color-controllable lights 102 along a decorative light strand and a decorating selector 104. In general, when decorative lighting apparatus 100 is plugged in and turned on, a plurality of electrically insulated wires 106 are controlled electronically to illuminate color-controllable lights 102 with particular colors depending on the user switch setting from decorating selector 104.

Decorating selector 104 includes a housing 105 and a switch 112 which provides for a plurality of color scheme settings. Housing 105 is a small, relatively light-weight housing, preferably mostly of plastic construction, which is sized to be held in a human hand. In this embodiment, switch 112 is a 10-position rotary switch, single-throw. However, the number of positions of switch 112 may be more or less depending on how many decorative settings are desired. In an alternative embodiment, switch 112 is a conventional push-button switch which provides the plurality of different settings sequentially when pressing the button. Other alternative switches may be utilized, such as the switches shown and described later in relation to FIGS. 14 and 15. As an alternative or added feature, the decorative lighting apparatus may utilize a wireless remote control device for selecting one of the desired color schemes. In this case, a wireless receiver with antenna is contained within housing 105 for receiving a wireless signal from the wireless remote control device.

Attached to decorating selector 104 is a conventional AC power cord and plug 108 for connecting to a conventional AC outlet for supplying power to illuminate color-controllable lights 102. A power supply (which includes a transformer and/or rectifier, for example) may be included within housing 105 for AC-to-DC conversion. Alternatively, the power supply may not be an integral component of decorative lighting apparatus 100 but rather a separate off-the-shelf component which interfaces with decorative lighting apparatus 100. Also alternatively, electrical power may be supplied by one or more batteries which are coupled to a battery interface (not shown) of decorative lighting apparatus 100.

Figure 2:
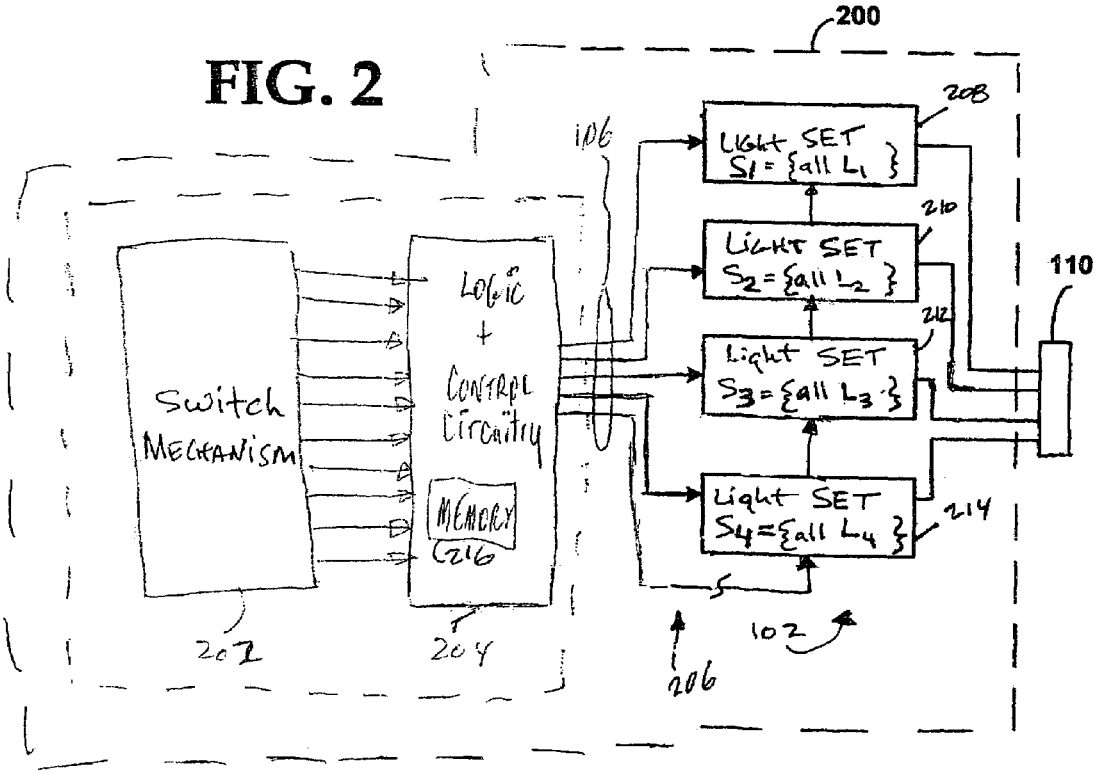
FIG. 2 is a schematic block diagram of electronics for the decorative lighting apparatus of FIG. 1.

FIG. 2 is a schematic block diagram of basic electronics 200 for decorative lighting apparatus 100 of FIG. 1. Electronics 200 of FIG. 2 include a switch mechanism 202, logic/control circuitry 204 which includes memory 216, and color-controllable lights 102. Logic/control circuitry 204 is contained within the housing and includes driver circuitry (not shown in FIG. 2) for driving color-controllable lights 102. As shown in FIG. 1, the switch 112 is visibly exposed outside housing 105 whereas the electronics of switch mechanism 202 (FIG. 2) are contained within housing 105. In the present embodiment, switch mechanism 202 has a plurality of logic outputs which change signal level based on the position of switch 112 (FIG. 1). Logic/control circuitry 204 is operative to read the signals from switch mechanism 202 and illuminate color-controllable lights 102 accordingly. Logic/control circuitry 204 may include a controller, a processor, logic gates, or combinations thereof. Preferably, logic/control circuitry 204 includes a microprocessor or microcontroller which is programmed with embedded software to perform the high-level functions described herein.

Figure 5:
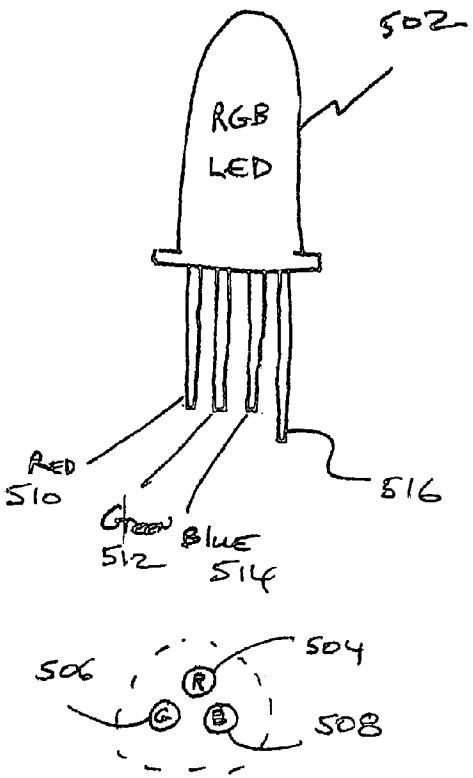
FIG. 5 is an illustration of a preferred color-controllable light for use in connection with the present invention, namely a Red-Green-Blue (RGB) Light-Emitting Diode (LED)

In the present application, color-controllable lights 102 are color-controllable Light-Emitting Diodes (LEDs). In particular, color-controllable lights 102 are tri-color LEDs of the Red-Green-Blue (RGB) type. Referring ahead to FIG. 5, a color-controllable RGB LED 502 is illustrated. Referring to its internal structure, color-controllable RGB LED 502 includes a red LED device 504 (as shown in a dashed insert) associated with a red color-control terminal 510, a green LED device 506 (as shown in the dashed insert) associated with a green color-control terminal 512, and a blue LED device 508 (as shown in the dashed insert) associated with a blue color-control terminal 514, packaged together as a single light source. A common ground terminal 516 is also utilized. As described in more detail herein, conventional color setting and mixing techniques are performed by logic/control circuitry 204 with these RGB LEDs to produce most any color (i.e. colors other than red, green, and blue; for example, orange, yellow, white, etc.). The RGB LED utilized in the present invention may be of the common anode type or the common cathode type.

Referring back to FIG. 1, color-controllable lights 102 (i.e. the RGB LEDs) are designated in a sequence of $L_1$, $L_2$, $L_3$, and $L_4$ along a light strand portion 114, which is repeated a plurality of times along wires 106 as shown in a following light strand portion 116 and again in another following light strand portion 118. Each color-controllable light 102 may be physically spaced apart from its adjacent light anywhere between about 1–13 centimeters, for example. In FIG. 2, it is shown that all $L_1$ lights may be logically grouped into a set $S_1$ (i.e. set 208); all $L_2$ lights may be logically grouped into a set $S_2$ (i.e. set 210); all $L_3$ lights may be logically grouped into a set $S_3$ (i.e. set 212); and all $L_4$ lights may be logically grouped into a set $S_4$ (i.e. set 214). As apparent from FIGS. 1–2, each light in any given set $S_1$, $S_2$, $S_3$, and $S_4$ is interleaved with lights of other sets along the decorative light strand. Lights in each set $S_1$, $S_2$, $S_3$, and $S_4$ are commonly-controlled by logic/control circuitry 204, separately and independently from other sets, to have the same color and intensity at any given time. Thus, color-controllable lights 102 include different sets $S_1$, $S_2$, $S_3$, and $S_4$ of independently controllable lights. Although four (4) sets of independently controllable lights are utilized in the present embodiment, any suitable number of two sets (2) or greater may be utilized.

Preferably, the color scheme settings provided by switch 112 of FIG. 1 correspond to most major U.S. holidays. As apparent from the icons provided on housing 105 (via a plastic overlay adhesively attached on the housing), the holiday color scheme settings include (in clockwise order) a New Year's holiday setting, a Valentines/Sweetest Day holiday setting, an Independence/Memorial Day holiday setting, a Halloween holiday setting, a Thanksgiving holiday setting, a Christmas holiday setting, and a Hanukkah holiday setting. Also included are a Party-1 setting (!!) and a Party-2 setting (!!!!). Advantageously, this strand of decorative lights can be permanently hung and utilized year-round for major holidays and/or other suitable occasions.

In one illustrative example, the New Year's holiday setting illuminates all white colors in color-controllable lights 102 ($L_1$=white; $L_2$=white; $L_3$=white; $L_4$=white); the Valentines/Sweetest Day holiday setting illuminates red and white colors (repeating sequence) in color-controllable lights 102 ($L_1$=red; $L_2$=white; $L_3$=red; $L_4$=white); the Independence/Memorial Day holiday setting illuminates red, white, and blue (repeating sequence) in color-controllable lights 102 ($L_1$=red; $L_2$=white; $L_3$=blue; $L_4$=off); the Halloween holiday setting illuminates all orange colors in color-controllable lights 102 ($L_1$=orange; $L_2$=orange; $L_3$=orange; $L_4$=orange); the Thanksgiving holiday setting illuminates red, yellow, orange, and green colors (repeating sequence) in color-controllable lights 102 ($L_1$=red; $L_2$=yellow; $L_3$=orange; $L_4$=green); the Christmas holiday setting illuminates red and green colors (repeating sequence) in color-controllable lights 102 ($L_1$=red; $L_2$=green; $L_3$=red; $L_4$=green); and the Hanukkah holiday setting illuminates blue and gold colors (repeating sequence) in color-controllable lights 102 ($L_1$=blue; $L_2$=gold; $L_3$=blue; $L_4$=gold). Also, the Party-1 setting illuminates blue and white colors (repeating sequence) in color-controllable lights 102 ($L_1$=blue; $L_2$=white; $L_3$=blue; $L_4$=white), and the Party-2 setting illuminates red, orange, blue, and purple colors (repeating sequence) in color-controllable lights 102 ($L_1$=red; $L_2$=orange; $L_3$=blue; $L_4$=purple).

Figure 3A:
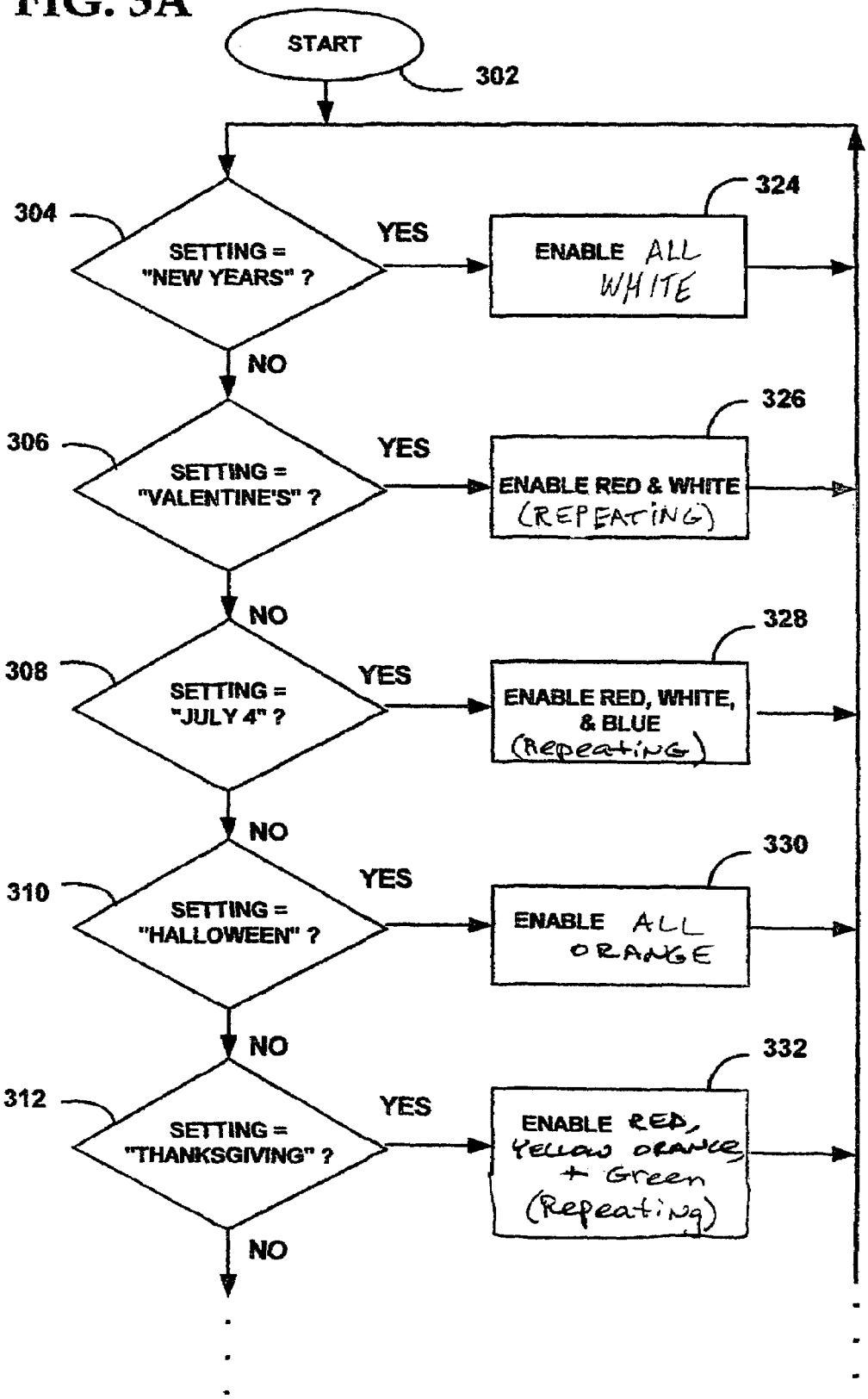
FIGS. 3A & 3B form a flowchart which describes a method of selecting color schemes with the decorative lighting apparatus of FIGS. 1 and 2.
Figure 3B:
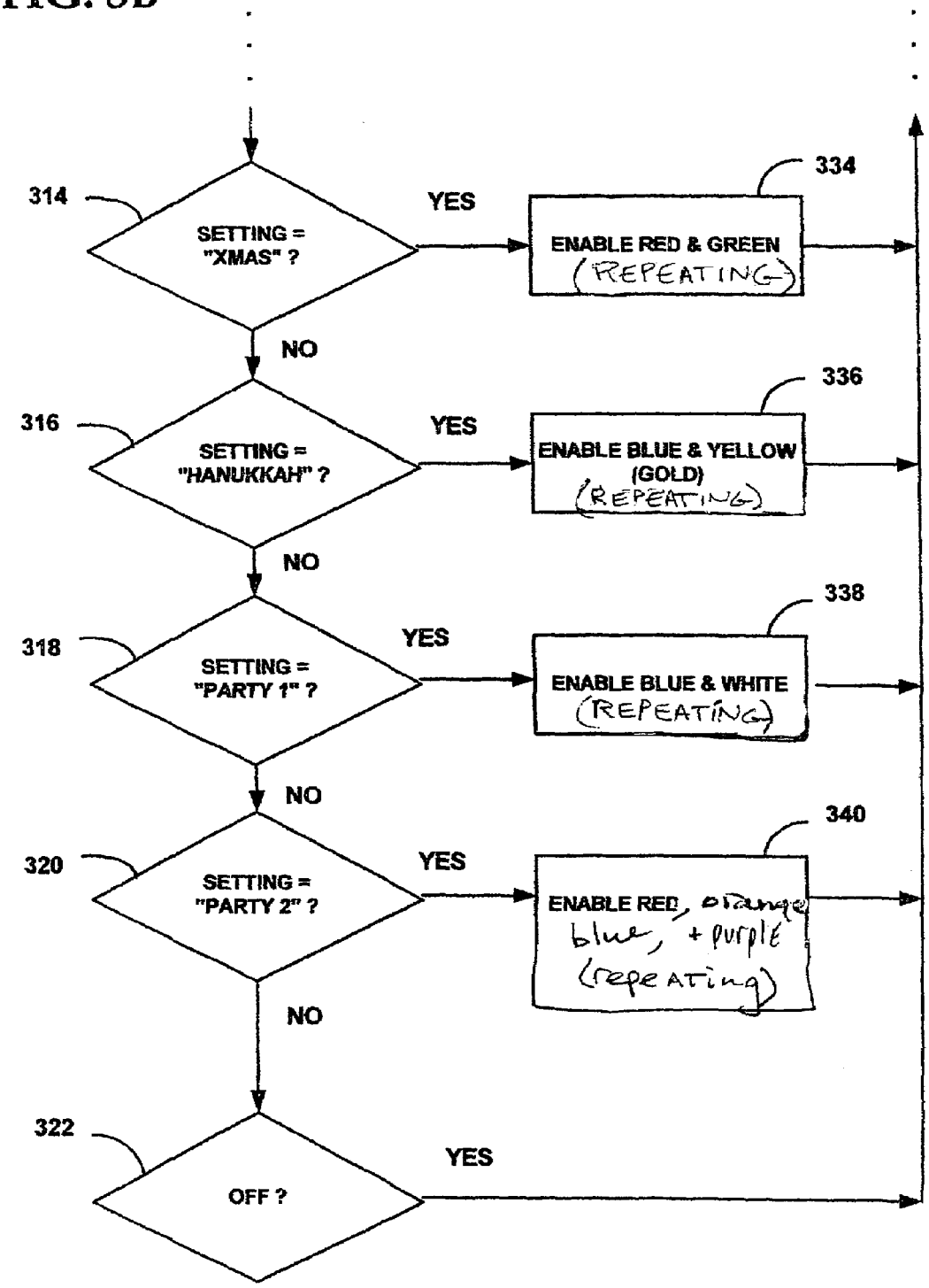

FIG. 3 is a flowchart which describes a method of selecting holiday color schemes using the decorative lighting apparatus 100 of FIG. 1. Beginning at a start block 302 in FIG. 3, if the switch setting is detected to be "New Year's" (step 304), then the logic/control circuitry enables white color only (step 324). If the switch setting is detected to be "Valentines/Sweetest Day" (step 306), then the logic/control circuitry enables red and white colors only (step 326). If the switch setting is detected to be "July 4/Memorial Day" (step 308), then the logic/control circuitry enables red, white, and blue colors only (step 328). If the switch setting is detected to be "Halloween" (step 310), then the logic/control circuitry enables orange color only (step 330). If the switch setting is detected to be "Thanksgiving" (step 312), then the logic/control circuitry enables the red, yellow, orange, and green colors only (step 332). If the switch setting is detected to be "Christmas" (step 314), then the logic/control circuitry enables red and green colors only (step 334). If the switch setting is detected to be "Hanukkah" (step 316), then the logic/control circuitry enables blue and gold colors only (step 336). If the switch setting is detected to be "Party-1" (step 318), then the logic enables blue and white colors only (step 338). If the switch setting is detected to be "Party-2" (step 320), then the logic enables red, orange, blue, and purple colors only (step 340). If the switch setting is detected to be "Off" (step 322), then no lights are enabled. The switch setting is continuously monitored so that, when set differently, the appropriate decorating lighting scheme is displayed.

Figure 4:
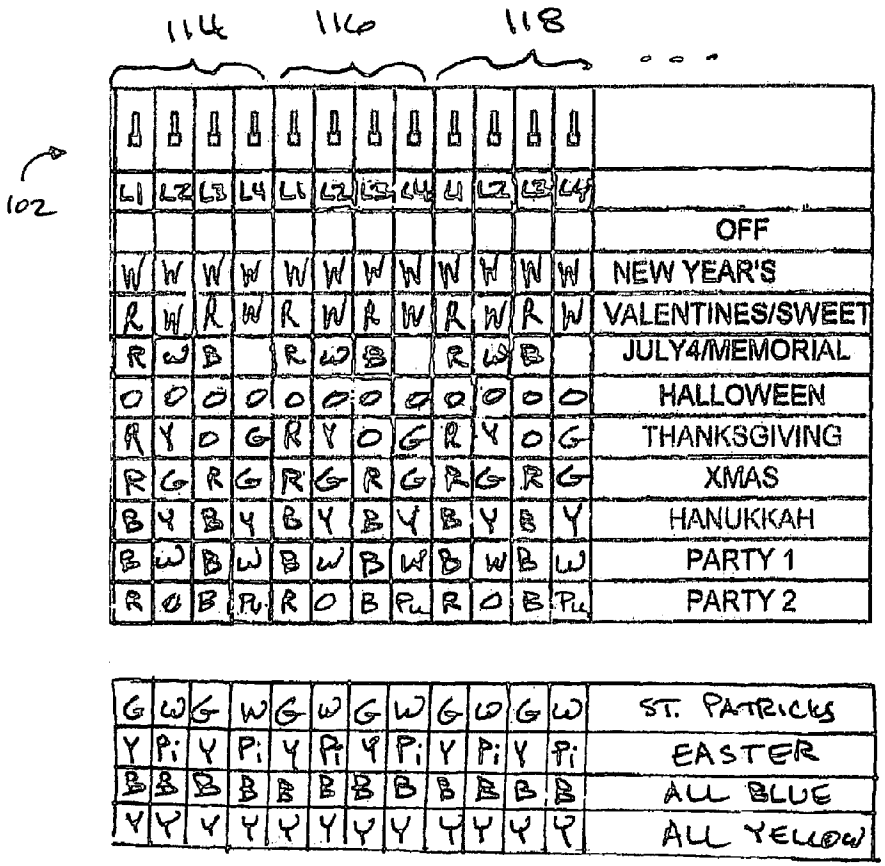
FIG. 4 is a color/light enabling scheme for the representative arrangement of color-controllable lights.

Referring ahead to FIG. 4, a light arrangement table 400 which shows the color/light enabling scheme in color-controllable lights 102. This figure illustrates more clearly how the decorating lighting apparatus may appear when particular color schemes are selected. A letter code in the table 400 indicates which particular color is illuminated in the lights: W=White; R=Red; B=Blue; Y=Yellow; O=Orange; G=Green; Pu=Purple; Pi=Pink; no letter code=OFF. Other examples of color schemes are shown, such as St. Patrick's Day corresponding to green and white colors (repeating sequence); Easter corresponding to yellow and pink colors (repeating sequence); all blue colors; and all yellow colors, etc.

Note that other suitable color schemes may be provided and the above are merely examples. The Christmas color scheme may illuminate four different colors (e.g. a repeating sequence of red, green, yellow, and blue); the Valentine's Day color scheme may illuminate red lights only; the Halloween color scheme may illuminate orange and yellow colors, etc. Preferably, other holidays and occasions are provided for as well, including Cinco de Mayo (red, white, and green colors) and Mardi Gras (purple, green, and gold colors). In addition, additional settings correspond to a simple single-color illumination along the entire light strand for each primary and secondary color. Further, additional color schemes corresponding to holidays or occasions suitable in other countries (non-U.S. countries) may be provided. The settings may be suitable for providing a plurality of different geographical regional color schemes such as different flag colors for different states (U.S. states such as Arizona, Colorado, Maine, etc.) or countries (France, Germany, Italy, China, etc.) or different holiday schemes for a non-U.S. country or countries. Even more additional settings provide color schemes which correspond to a plurality of different sports teams such as different football teams (Chicago Bears, New York Giants, San Diego Chargers, etc.), baseball teams, soccer teams, hockey teams, etc. Preferably, any dominancy color in a color scheme (e.g. white in Japan's national flag, or navy blue in the Chicago Bears color scheme) may be accounted for in an additional or more relatively proportionate number of illuminated colors in the decorative light strand. In a 40 LED light strand, for example, a national flag color scheme for Japan would provide 30 LEDs with the color white and 10 LED nodes with the color red. As another example, a Chicago Bears color scheme would provide 30 LEDs with the color navy blue and 10 LEDs with the color orange.

Preferably, each color scheme provided for does not change over time and remains generally fixed in color(s). However, this does not mean that the colors must be constantly illuminated or fixed in position; the colors may indeed be flashed, alternating, and/or "moved" along the decorative light strands in any suitable predictable or random fashion.

Referring back to FIG. 1, a male connecting plug 130 is attached at the front end of wires 106 and a female connecting socket 110 is attached at the rear end of wires 106. Male connecting plug 130 mates with a female connecting socket provided on housing 105, which is the same type as female connecting socket 110. Female connecting socket 110 is provided so that additional color-controllable lights of the same type may be added to the lighting strand and controlled by the same decorating selector 104. With the configuration provided in FIG. 1, decorating selector 104 and the decorative light strand may be separate and independent devices and sold separately from one another. A specific example of mating connectors will be shown and described later in relation to FIG. 13.

Figure 6:
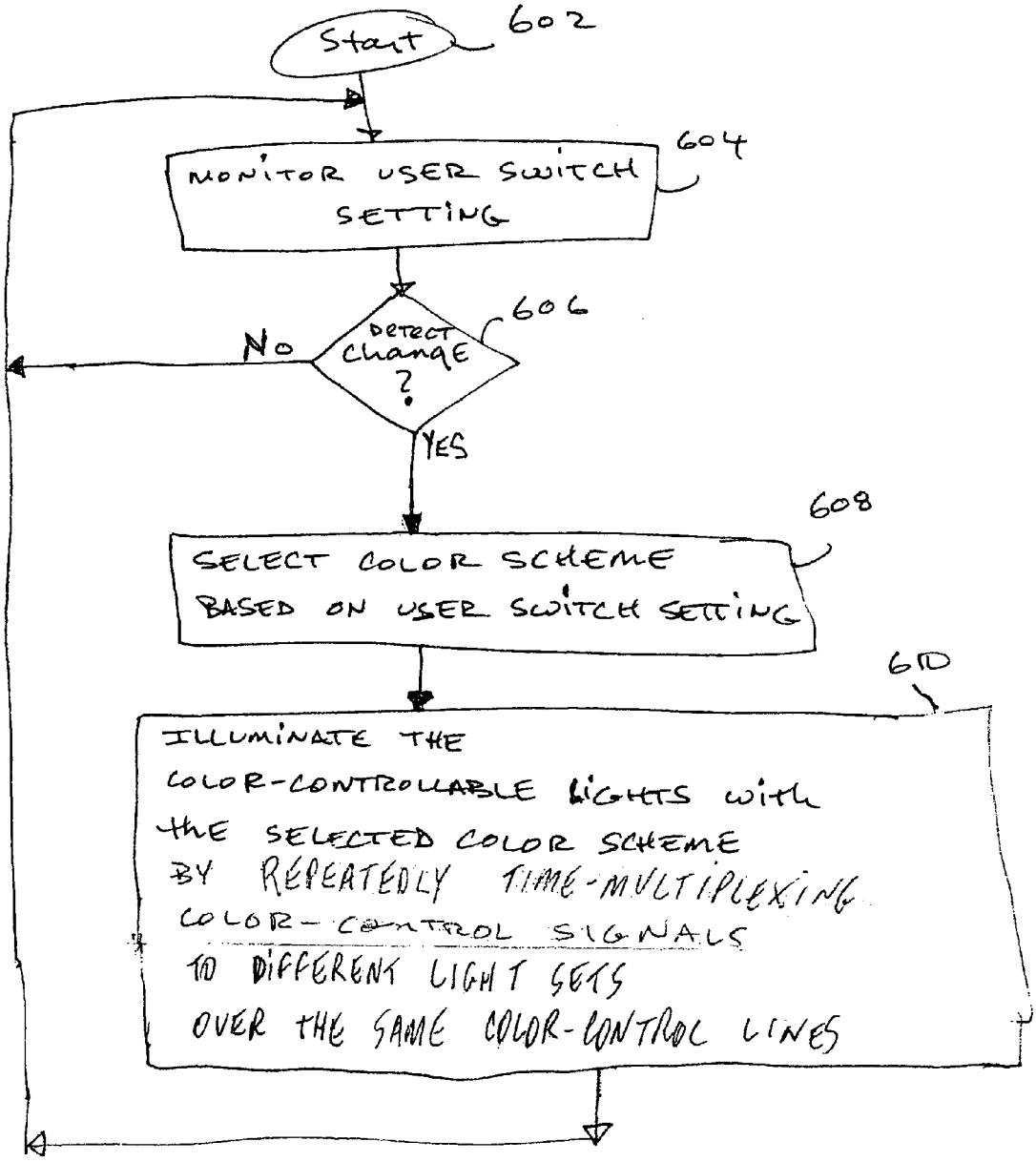
FIG. 6 is a flowchart which describes a method of providing control in a decorative lighting apparatus for user-selectable color schemes according to the present invention.

Referring back to FIG. 2, logic/control circuitry 204 preferably includes a microcontroller or microprocessor programmed with embedded software to accomplish high-level functions described herein. Memory 216 is preprogrammed to store data corresponding to all or a limited subset of the color schemes described above. Referring now to FIG. 6, a flowchart which describes an operating method of the logic/control circuitry 204 for user-selectable color schemes is provided. Beginning at a start block 602 of FIG. 6, user switch settings of the decorating selector or switch are monitored (step 604 of FIG. 6). If no change in the user switch setting is identified (step 606 of FIG. 6), then monitoring of the user switch settings are continued at step 604. If a change in the user switch setting is identified (step 606 of FIG. 6), then color scheme data corresponding to the user switch setting are identified or selected from memory (step 608 of FIG. 6). The color scheme data include color data for each different light set (e.g. each set $S_1$, $S_2$, $S_3$, and $S_4$). Preferably, the color data are stored in memory in association with a corresponding light set identification, and are appropriately selected based on the user switch setting. The color-controllable lights are then illuminated with the selected color scheme by repeatedly time-multiplexing color-control signals corresponding to the color scheme data to different light sets over the same color-control lines (step 610 of FIG. 6). Note that many of the color schemes have at least two colors which are illuminated in a repeated interleaved pattern along the decorative light strand. The step 610 of performing such time-multiplexed color control will be described in more detail below in connection with FIGS. 7–10. The color scheme remains illuminated along the decorative light strand until the next color scheme is selected, where the method repeats at step 604.

Preferably, the memory stores a single one-to-one light-set-to-color-data relationship for each color scheme. If four (4) different LED sets are utilized, for example, then at most each color scheme has four (4) color data items associated with four (4) different LED sets. It is preferred that the colors in each color scheme remain substantially the same over time. However, this does not mean that the colors must be continuously illuminated or fixed in position over time; the colors may indeed be flashed, alternated over time, and/or "moved" along the decorative light strands in any suitable predictable or random fashion. Instead of providing additional light-set-to-color-data in memory for any "effects" in each color scheme, such effects are provided by utilizing common software algorithms which may be used for some if not all color schemes. Note that such a software algorithm utilizes the same color data as provided in the light-set-to-color data relationship to maintain color-consistency with the selected color scheme. One software algorithm may provide for a predictable "flashing" of the color scheme; in this case some or all of the LED nodes are repeatedly controlled from ON-to-OFF by sending appropriate data to them at an appropriate time. Another software algorithm may provide for a "random sparkling" of the color scheme; in this case some LED nodes selected by random-number generation are controlled from ON-to-OFF or lower intensity repeatedly by sending appropriate data to them at an appropriate time.

The software which is programmed to cause the color schemes to be illuminated in response to user switch settings may be stored in read-only memory (ROM) in a "hard-coded" fashion, whereas the data to provide the color schemes may be stored in an erasable and/or rewritable memory such as an electrically erasable/programmable ROM (EEPROM) or FLASH memory. Thus, from product to product, the hardcoded software in ROM need not be different or ever change if the microprocessor is provided or utilized with a reprogrammable memory in which the color scheme data is stored. This approach is particularly advantageous so that a variety of different product lines that differ only by pre-programmed color scheme data (and e.g. a plastic icon overlay or other color scheme indication) may be easily manufactured. Alternatively, the programmed software and color scheme data may be stored in the same memory (e.g. both in FLASH memory).

Figure 7:
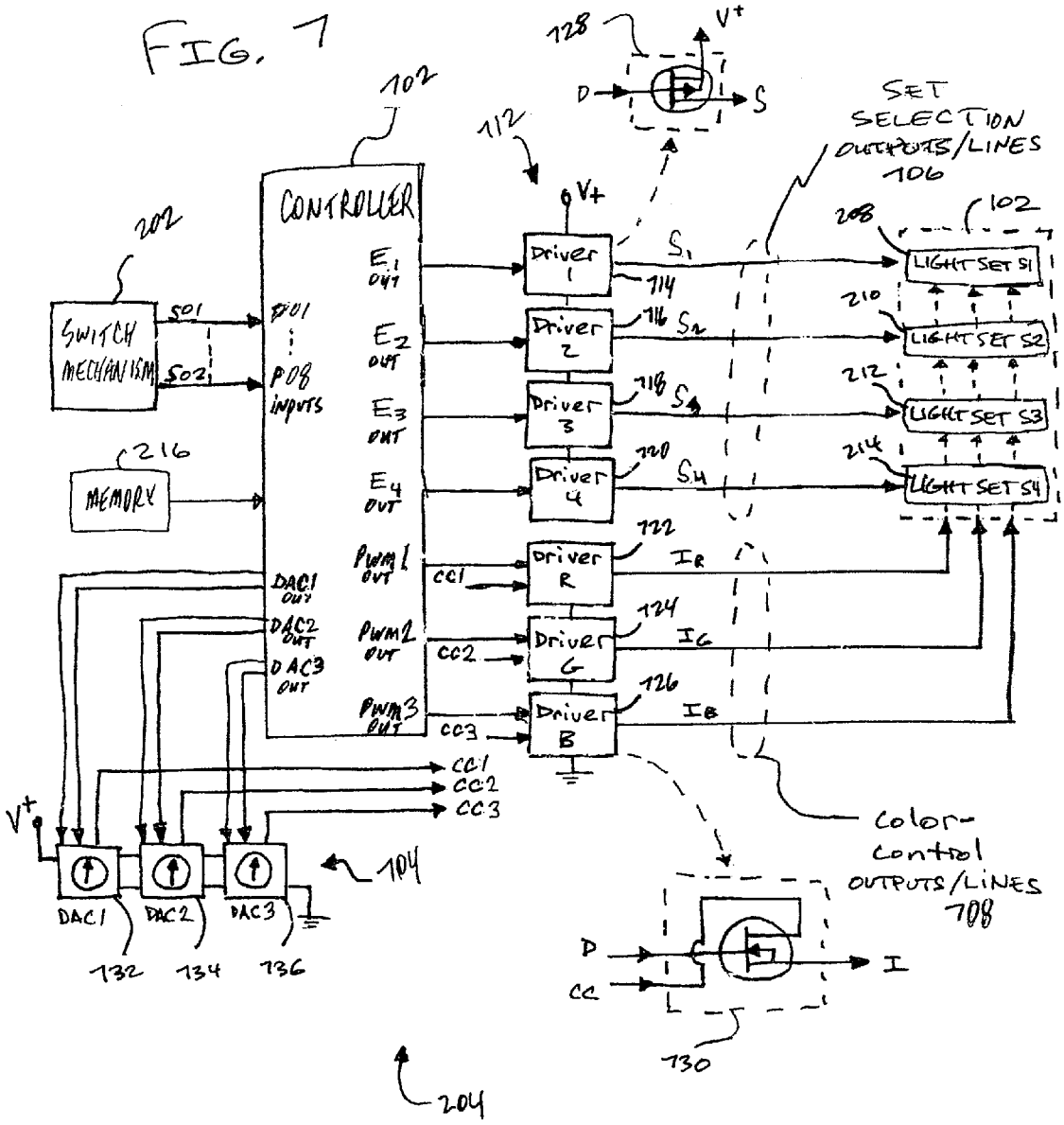
FIG. 7 is a schematic diagram of one example of detailed control circuitry which may be used in connection with the present invention.
Figure 8:
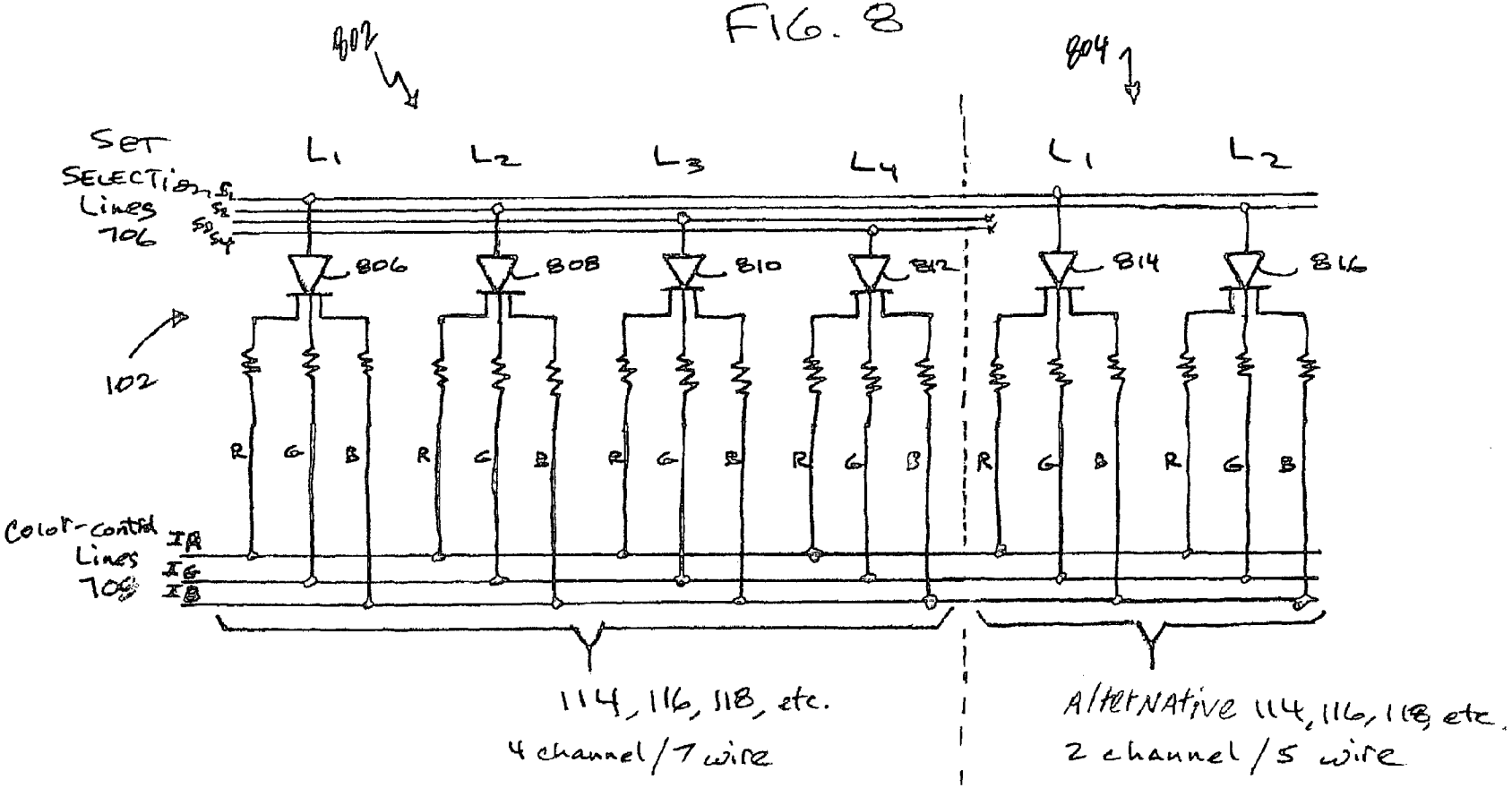
FIG. 8 is a schematic diagram which shows two examples of the configuration of color-controllable lights (e.g. RGB LEDs) along the decorative light strand.

FIG. 7 is a schematic diagram of one example of detailed control circuitry 204 which may be used in connection with the present invention. Note that the specific implementation which will be described in relation to FIGS. 7 and 8 provides what is referred to as a "four-channel, seven-wire" configuration. Control circuitry 204 of FIG. 7 includes a controller 702, a plurality of controllable current sources 704, and a plurality of switch or driver circuits 712. Controller 702 may be a microcontroller or microprocessor, for example, which is programmed with embedded software for operation. In general, control circuitry 204 performs two major functions: (1) the high-level function of illuminating color-controllable lights 102 with a different color scheme for each user-selectable switch setting; and (2) the low-level function of illuminating the color-controllable lights 102 with the selected color scheme by repeatedly time-multiplexing color-control signals corresponding to the color scheme to different light sets 208, 210, 212, and 214 over the same color-control lines 708.

The low-level function of time-multiplexing is advantageous so that the total number of wires along the decorative light strand may be reduced or minimized without losing versatility. The time-multiplexing is preferably performed at a sufficiently high frequency (e.g. greater than 32 Hertz) such that all color-controllable lights 102 appear to the human eye to be simultaneously illuminated. For illuminating an appropriate color for any given light set, control circuitry 204 operates to perform conventional color setting and mixing techniques, such as Pulse Width Modulation (PWM and/or variable current control, over common color-control lines 708.

Switch mechanism 202 and memory 216 are coupled to controller 702, where controller 702 continuously monitors switch inputs from switch mechanism 202 and selects one of a plurality of color scheme data from memory 216 based on the switch setting. Controller 702 uses this color scheme data to illuminate color-controllable lights 102 according to the selected color scheme. Color-controllable lights 102 of each set are commonly-controlled by control circuitry 204, separately and independently from other sets, to have the same color and intensity at a given time. Although four (4) sets $S_1$, $S_2$, $S_3$, and $S_4$ of independently color-controllable lights are utilized in the present embodiment, any suitable number of two sets (2) or greater may be utilized.

For illuminating the color schemes in color-controllable lights 102, controller 702 has outputs which are coupled to color-controllable lights 102 through driver circuits 712. In the present embodiment, driver circuits 712 include seven (7) driver circuits 714, 716, 718, 720, 722, 724, and 726. Driver circuits 714, 716, 718, and 720 utilize "high-side" switches (see an exemplary high-side switch configuration 728 with a P-channel MOSFET in the dashed insert) whereas driver circuits 722, 724, and 726 utilize "low-side" switches (see an exemplary low-side switch configuration 730 with a P-channel MOSFET in the dashed insert). Outputs from driver circuits 714, 716, 718, and 720 are coupled to a plurality of set selection lines 706 (indicated as $S_1$, $S_2$, $S_3$, and $S_4$), whereas outputs from driver circuits 722, 724, and 726 are coupled to a plurality of color-control lines 708 (indicated as $I_R$, $I_G$, and $I_B$). Outputs from the driver circuitry 722, 724, and 726, which are generally outputs from control circuitry 204, may be referred to as color-control outputs.

Set selection lines 706 and color-control lines 708 are coupled to color-controllable lights 102 as will be described in more detail in relation to FIGS. 8 and 11. In the present embodiment, each of the color-controllable lights 102 is a red-green-blue (RGB) light-emitting diode (LED). Each color-control terminal of the same color for all RGB LEDs is coupled to the same color-control line from the control circuitry; that is, color-control line 708 for current $I_R$ is coupled to all red color-control terminals of all RGB LEDs in all sets $S_1$, $S_2$, $S_3$, and $S_4$; color-control line 708 for current $I_G$ is coupled to all green color-control terminals of all RGB LEDs in all sets $S_1$, $S_2$, $S_3$, and $S_4$; and color-control line 708 for current $I_B$ is coupled to all blue color-control terminals of all RGB LEDs in all sets $S_1$, $S_2$, $S_3$, and $S_4$. If common-anode RGB LEDs are utilized (e.g. as shown and described in relation to FIG. 8), each set selection line 706 is coupled to the anode of each RGB LED of its corresponding set for selectively enabling the set for color control. If common-cathode RGB LEDs are utilized, each set selection line 706 is coupled to the cathode of each RGB LED of its corresponding set for selectively enabling the set for color control.

More specifically, an output $E_1$ from controller 702 is coupled to driver circuit 714 which has a color-control output $S_1$ for selectively enabling light set $S_1$ 208; an output $E_2$ from controller 702 is coupled to driver circuit 716 which has a color-control output $S_2$ for selectively enabling light set $S_2$ 210; an output $E_3$ from controller 702 is coupled to driver circuit 718 which has a color control output $S_3$ for selectively enabling light set $S_3$ 212; and an output $E_4$ from controller 702 is coupled to driver circuit 720 which has a color-control output $S_4$ for selectively enabling light set $S_4$ 214. In addition, a "pulse width modulated" PWM1 output from controller 702 is coupled to driver circuit 722 which has output $I_R$ for controlling a color red in the RGB LEDs; a PWM2 output from controller 702 is coupled to driver circuit 724 which has output 10 for controlling a color green in the RGB LEDs; and a PWM3 output from controller 702 is coupled to driver circuit 726 which has output $I_B$ for controlling a color blue in the RGB LEDs.

Controllable current sources 704, which here include digital-to-analog (DAC) conversion circuits, are coupled to DAC outputs from controller 702. The use of controllable current sources 704 may be optional. In this embodiment, there are three (3) DACs 732 (DAC1), 734 (DAC2), and 736 (DAC3) with two (2) DAC outputs from controller 702 being utilized for setting the current. However, the number of DACs and DAC outputs utilized may vary depending on the design. An output line from DAC 732 provides a current CC1 and is coupled to an input to driver circuit 722. Similarly, an output line from DAC 734 provides a current CC2 and is coupled to an input to driver circuitry 724, and an output line from DAC 736 provides a current CC3 and is coupled to an input to driver circuitry 726.

FIG. 8 is a schematic diagram which shows two examples of the configuration of color-controllable lights (e.g. RGB LEDs) along the decorative light strand, namely a first LED configuration 802 and a second LED configuration 804. First LED configuration 802 corresponds to the "four-channel, seven-wire" configuration associated with FIG. 7. In first LED configuration 802 of FIG. 8, four RGB LEDs corresponding to $L_1$, $L_2$, $L_3$, and $L_4$ are coupled to set selection lines 706 and color-control lines 708 as shown; this configuration is repeated along the decorative light strand a plurality of times. Again, all $L_1$s are in set $S_1$, all $L_2$s are in set $S_2$, all $L_3$s are in set $S_3$, and all $L_4$s are in set $S_4$. Each first RGB LED 806 ("$L_1$") has a common anode which is coupled to the $S_1$ set selection line, a red color-control terminal coupled to the $I_R$ color-control line, a green color-control terminal coupled to the $I_G$ color-control line, and a blue color-control terminal coupled to the $I_B$ color-control line; each second RGB LED 808 ("$L_2$") has a common anode which is coupled to the $S_2$ set selection line, a red color-control terminal coupled to the $I_R$ color-control line, a green color-control terminal coupled to the $I_G$ color-control line, and a blue color-control terminal coupled to the $I_B$ color-control line; each third RGB LED 810 ("$L_3$") has a common anode which is coupled to the $S_3$ set selection line, a red color-control terminal coupled to the $I_R$ color-control line, a green color-control terminal coupled to the $I_G$ color-control line, and a blue color-control terminal coupled to the $I_B$ color-control line; and each fourth RGB LED 812 ("$L_4$") has a common anode which is coupled to the $S_4$ set selection line, a red color-control terminal coupled to the $I_R$ color-control line, a green color-control terminal coupled to the $I_G$ color-control line, and a blue color-control terminal coupled to the $I_B$ color-control line. As shown, a current-limiting resistor (optional) is provided between each color-control terminal and the color-control line to which it is coupled.

In second LED configuration 804 of FIG. 8, only two RGB LEDs corresponding to $L_1$ and $L_2$ are coupled to set selection lines 706 and color-control lines 708 as shown; this configuration is repeated along the decorative light strand a plurality of times. Second LED configuration 804 corresponds to a "two-channel, five-wire" configuration. Here, all $L_1$s are in set $S_1$ and all $L_2$s are in set $S_2$. Each first RGB LED 814 ("$L_1$") has a common anode which is coupled to the $S_1$ set selection line, a red color-control terminal coupled to the $I_R$ color-control line, a green color-control terminal coupled to the $I_G$ color-control line, and a blue color-control terminal coupled to the $I_B$ color-control line; and each second RGB LED 816 ("$L_2$") has a common anode which is coupled to the $S_2$ set selection line, a red color-control terminal coupled to the $I_R$ color-control line, a green color-control terminal coupled to the $I_G$ color-control line, and a blue color-control terminal coupled to the $I_B$ color-control line. As shown, a current-limiting resistor (optional) is provided between each color-control terminal and the color-control line to which it is coupled.

FIG. 9 is a flowchart which describes a method of providing time-multiplexed color-control in the decorative lighting apparatus in connection with the present invention. This method may be utilized with the circuitry and configurations described in relation to FIGS. 7–8, for example. A color scheme has already been selected by the end user. Beginning at a start block 902, one of the sets $S_N$ of RGB LEDs is selected during a time period $T_N$ (step 904 of FIG. 9). For example, N=1 for the RGB LED set $S_1$. Next, color setting and mixing techniques are utilized to illuminate a color $C_N$ of the selected color scheme in set $S_N$ during time period $T_N$. In particular, color setting data $S_N$(R) for red, $S_N$(G) for green, and $S_N$(B) for blue, which together represent the color $C_N$ in the selected color scheme, are read from memory (step 906 of FIG. 9). If color setting data $S_N$(R) for red exists and is necessary to produce the color $C_N$ in set $S_N$ of the RGB LEDs (decision 908 of FIG. 9), then color-control signals are generated during time period $T_N$ for enabling red for a duration $D_R$ (for PWM) and/or with an appropriate current $I_R$ (step 910 of FIG. 9). If color setting data $S_N$(G) for green exists and is necessary to produce the color $C_N$ in set $S_N$ of the RGB LEDs (decision 912 of FIG. 9), then color-control signals are generated during time period $T_N$ for enabling green for a duration $D_G$ (for PWM) and/or with an appropriate current $I_G$ (step 914 of FIG. 9). If color setting data $S_N$(B) for blue exists and is necessary to produce the color $C_N$ in set $S_N$ of the RGB LEDs (decision 916 of FIG. 9), then color-control signals are generated during time period $T_N$ for enabling blue for a duration $D_B$ (for PWM) and/or with an appropriate current $I_B$. Thus, steps 908 through 918 may be repeated a sufficient number of times over the time period $T_N$ for color setting and/or mixing to produce the desired color $C_N$ in set $S_N$ (decision 920 of FIG. 9).

The method then repeats back at step 904, for the next Nth set. Specifically, a next one of the sets $S_N$ of the RGB LEDs is selected during a next time period $T_N$ (step 904). For example, N=2 for the next RGB LED set $S_2$. Next, color setting or mixing techniques are utilized in steps 908–920 as previously described to illuminate a next color $C_N$ of the color scheme in next set $S_N$ during this next time period $T_N$. The color setting or mixing for this next set $S_N$ utilizes the same color-control lines utilized to color-set or mix the initial set $S_N$. Steps 904 through 920 are therefore repeated for as many N sets of RGB LEDs that are provided along the decorative light strand. For the embodiment described in relation to FIGS. 7–8, N=4; preferably, however, N=2 or greater. These sets may be interleaved, and selected and illuminated in a consecutive "round-robin" manner (for example, N=1, 2, 3, 4, 1, 2, 3, 4, 1, 2, 3, 4, . . . ). However, other selection techniques such as non-consecutive selection or random-selection may be suitable. Preferably, the time-multiplexing of the N sets is performed at a sufficiently high frequency (e.g. greater than 32 Hertz) such that all RGB LEDs appear to the human eye to be simultaneously illuminated. However, the frequency of the time-multiplexing of the N sets may be lower than 32 Hertz (e.g. 1 Hertz or greater) to provide an effect of "alternating" light colors along the decorative light strand.

As apparent from the description of the method of FIG. 9, the memory stores color scheme data to illuminate a plurality of different colors in the RGB LEDs. If four (4) sets of RGB LEDs are utilized, for example, each color scheme has data fields corresponding to a maximum of four (4) possible colors; for each color of the four (4) colors, there are color setting data fields for $S_N$(R) for red, $S_N$(G) for green, and $S_N$(B) for blue. If two (2) sets of RGB LEDs are utilized, for example, each color scheme has data fields corresponding to a maximum of two (2) possible colors; for each color of the two (2) colors, there are color setting data fields for $S_N$(R) for red, $S_N$(G) for green, and $S_N$(B) for blue.

Figures 10A, 10B, 10C, 10D, 10E:
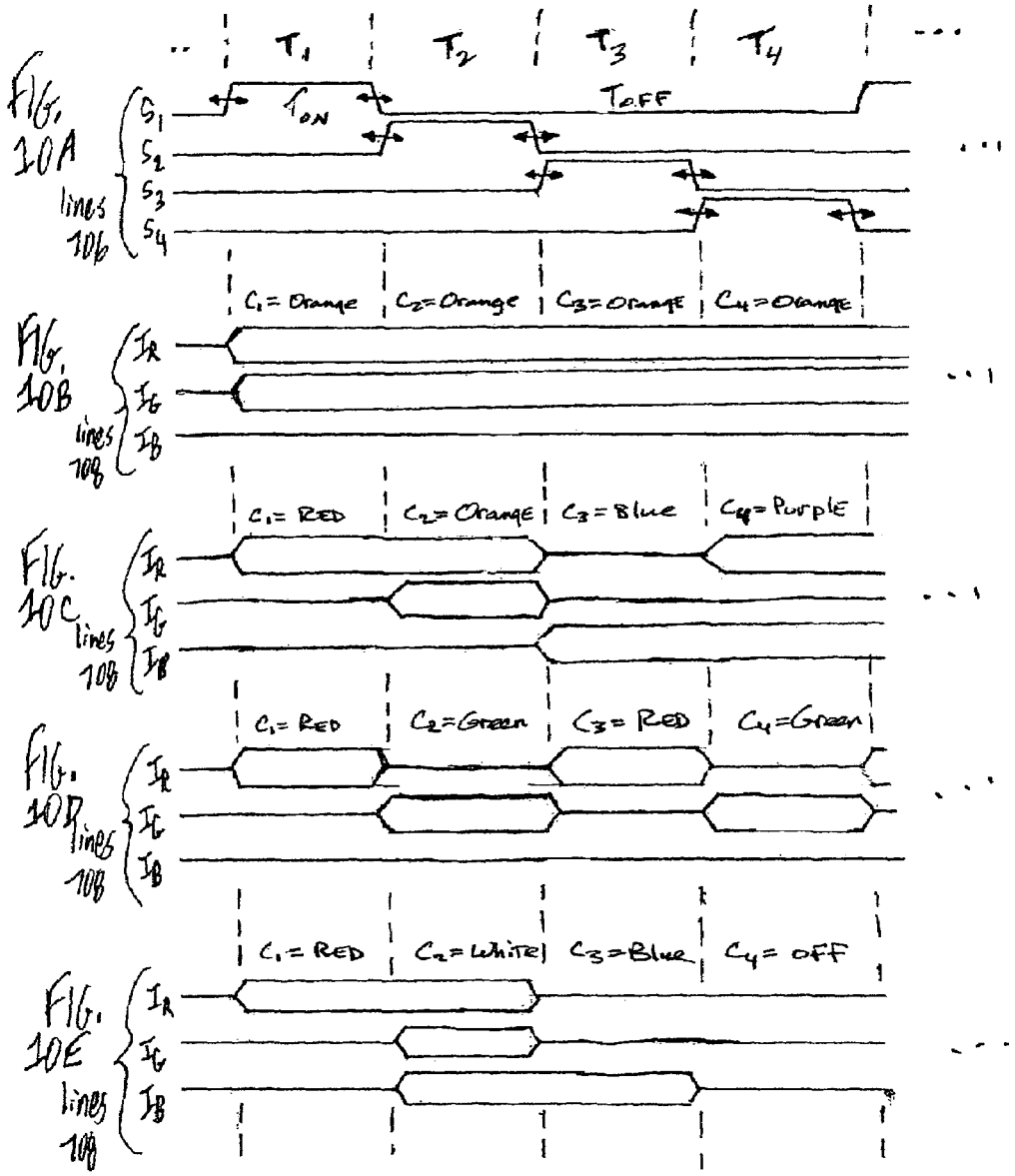
FIGS. 10A through 10E are examples of timing diagrams for time-multiplexed color-control which are related to the specific embodiment described in relation to FIGS. 7–9.

FIGS. 10A through 10E are examples of timing diagrams for time-multiplexed color-control which are related to the specific embodiment described in relation to FIGS. 7–9. FIG. 10A reveal set selection signals along set selection lines 706 ($S_1$, $S_2$, $S_3$, and $S_4$) during time periods $T_1$, $T_2$, $T_3$, and $T_4$, whereas FIGS. 10B–10E reveal several examples of color-control signals along color-control lines 708 ($I_R$, $I_G$, and $I_B$) for different color schemes. Referring first to FIG. 10A, during time period $T_1$, $S_1$ output is set high and $S_2$–$S_4$ are set low to select set $S_1$ for color-control and illumination. During time period $T_2$, $S_2$ output is set high and $S_1$ and $S_3$–$S_4$ are set low to select set $S_2$ for color-control and illumination. During time period $T_3$, $S_3$ output is set high and $S_1$–$S_2$ and $S_4$ are set low to select set $S_3$ for color-control and illumination. During time period $T_3$, $S_4$ output is set high and $S_1$–$S_3$ are set low to select set $S_4$ for color-control and illumination. This selection is repeated over and over again, over a relatively long time period. Note that a time duration TON ("on" time) of the selection signal is roughly equal to a time duration $T_{OFF}$ ("off" time) divided by four (4). Preferably, the time-multiplexing from $T_1$–$T_4$ (and repeat) is performed at a sufficiently high frequency (e.g. greater than 32 Hertz) such that all RGB LEDs appear to the human eye to be simultaneously illuminated. However, the frequency of the time-multiplexing may be lower than 32 Hertz (e.g. 1 Hertz or greater) to provide an effect of "alternating" light colors along the decorative light strand.

In FIG. 10B, color-control signals for a color scheme corresponding to Halloween as all orange colors along the decorative light strand are shown. Color-control signals are provided along $I_R$ and $I_G$ lines, but not the $I_B$ line, during all time periods $T_1$, $T_2$, $T_3$, and $T_4$. Such color mixing of red and green results in the illumination of the color orange in all RGB LEDs of sets $S_1$, $S_2$, $S_3$, and $S_4$.

In FIG. 10C, color-control signals for a color scheme corresponding to "Party-2" setting (see FIGS. 3A–3B and 4) as a repeating sequence of red, orange, blue, and purple colors along the decorative light strand are shown. During time period $T_1$, a color-control signal is provided along the $I_R$ line, but not $I_G$ and $I_B$ lines, to illuminate the color red in set $S_1$. During time period $T_2$, color-control signals are provided along $I_R$ and $I_G$ lines, but not the $I_B$ line, where such color mixing of red and green results in the illumination of the color orange in set $S_2$. During time period $T_3$, a color-control signal is provided along the $I_B$ line, but not $I_R$ and $I_G$ lines, to result in the illumination of the color blue in set $S_3$.

During time period $T_4$, color-control signals are provided along $I_R$ and $I_B$ lines, but not $I_G$ line, where such color mixing of red and blue results in the color purple in set $S_4$.

In FIG. 10D, color-control signals for a color scheme corresponding to Christmas as a repeating sequence of red and green along the decorative light strand are shown. During time period $T_1$, a color-control signal is provided along the $I_R$ line, but not $I_G$ and $I_B$ lines, to illuminate the color red in set $S_1$. During time period $T_2$, a color-control signal is provided along the $I_G$ line, but not $I_R$ and $I_B$ lines, to illuminate the color green in set $S_2$. During time period $T_3$, a color-control signal is provided along the $I_R$ line, but not $I_G$ and $I_B$ lines, to illuminate the color red in set $S_3$. During time period $T_4$, a color-control signal is provided along the $I_G$ line, but not $I_R$ and $I_B$ lines, to illuminate the color green in set $S_4$.

In FIG. 10E, color-control signals for a color scheme corresponding to Independence Day as a repeating sequence of red, white, and blue along the decorative light strand are shown. During time period $T_1$, a color-control signal is provided along the $I_R$ line, but not $I_G$ and $I_B$ lines, to illuminate the color red in set $S_1$. During time period $T_2$, color-control signals are provided along the $I_R$, $I_G$, and $I_B$ lines to illuminate the color white in set $S_2$. During time period $T_3$, a color-control signal is provided along the $I_B$ line, but not $I_R$ and $I_G$ lines, to illuminate the color blue in set $S_3$. During time period $T_4$, no color-control signal is provided along the $I_R$, $I_G$, and $I_B$ lines so that set $S_4$ are all unlit.

FIG. 11 is a schematic diagram which shows another example of an LED configuration 1102 along the decorative light strand. In LED configuration 1102, four (4) RGB LEDs corresponding to $L_1$, $L_2$, $L_3$, and $L_4$ are coupled to set selection lines 706 and color-control lines 708 as shown; this configuration is actually repeated along the decorative light strand a plurality of times. LED configuration 1102 corresponds to a "four-channel, five-wire" configuration. Here, all $L_1$s are in set $S_1$; all $L_2$s are in set $S_2$; all $L_3$s are in set $S_3$; and all $L_4$s are in set $S_4$. In particular, each first RGB LED 1104 ("$L_1$") has a common anode which is coupled to the $S_1$ set selection line, a red color-control terminal coupled to the $I_R$ color-control line, a green color-control terminal coupled to the $I_G$ color-control line, and a blue color-control terminal coupled to the $I_B$ color-control line; each second RGB LED 1106 ("$L_2$") has a common anode which is coupled to the $S_2$ set selection line, a red color-control terminal coupled to the $I_R$ color-control line, a green color-control terminal coupled to the $I_G$ color-control line, and a blue color-control terminal coupled to the $I_B$ color-control line. On the other hand, each third RGB LED 1108 ("$L_3$") has a common cathode which is coupled to the $S_1$ set selection line, a red color-control terminal coupled to the $I_R$ color-control line, a green color-control terminal coupled to the $I_G$ color-control line, and a blue color-control terminal coupled to the $I_B$ color-control line; and each fourth RGB LED 1110 ("$L_4$") has a common cathode which is coupled to the $S_2$ set selection line, a red color-control terminal coupled to the $I_R$ color-control line, a green color-control terminal coupled to the $I_G$ color-control line, and a blue color-control terminal coupled to the $I_B$ color-control line. As shown, a current-limiting resistor (optional) is provided between each color-control terminal and the color-control line to which it is coupled.

FIG. 12 is a diagram of switching/driver circuits 1202 which may be utilized with the LED configuration provided for in FIG. 11, and as substitutes for driver circuits 712 earlier shown and described in relation to FIG. 7. Each driver circuit in FIG. 12 includes a first switch 1204 and a second switch 1208; these may be N-channel MOSFETs. First switch 1204 has a gate 1212 coupled to a first controller output, a drain 1216 coupled to a first reference voltage (high), and a source coupled to a drain of second switch 1208. Second switch 1208 has a gate 1214 coupled to a second controller output and a source 1210 coupled to a second reference voltage (low or ground); drain is utilized as a driver circuit output 1206 to the RGB LEDs. With driver circuits 1202, three relevant switching states are used for LED set selection of four sets using only two set selection lines: high, low, and tri-state. By tri-state, it is meant that the line is neither held high nor low; rather the line is "floating". Advantageously, a relatively large number of LED sets may be controlled using a reduced or minimized number of wires for color control.

Figure 13:
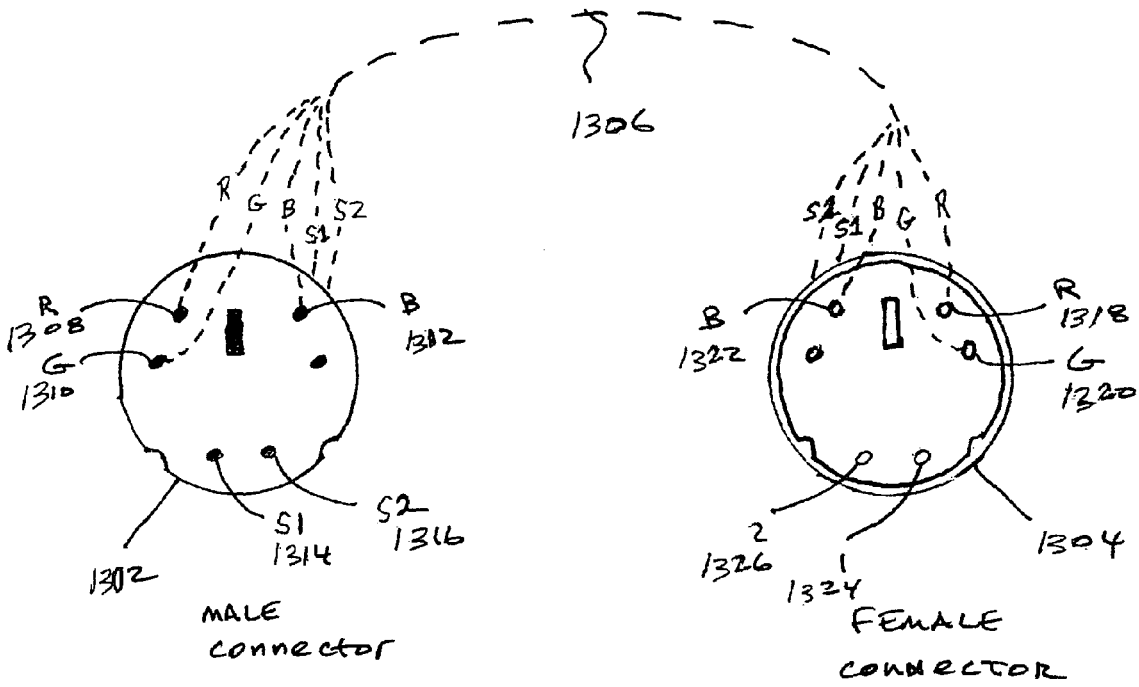
FIG. 13 is an illustrative example of male and female connectors of the decorative light strand which may be used for connecting additional light strands with common-control using the same decorating selector.

FIG. 13 is an illustration of a decorative light strand 1306 having a male connector 1302 on one end thereof and a female connector 1304 on the other end thereof. This decorative light strand 1306, which is made of a plurality of electrically conductive wires surrounded by insulator material, has a configuration suitable for the LED arrangements shown and described in relation to FIG. 8 or FIG. 11, for example. For illustrative clarity, male and female connectors 1302 and 1304 are shown much larger than actual size in the drawing. Male connector 1302 includes a red (R) color-control pin 1308, a green (G) color-control pin 1310, a blue (B) color-control pin 1312, and one or more LED set selection pins 1314 and 1316 ($S_1$ and $S_2$), all of which are embodied within a male connector housing. Similarly, female connector 1304 includes a red (R) color-control pin hole 1318, a green (G) color-control pin hole 1320, a blue (B) color-control pin hole 1322, and one or more LED set selection pins holes 1324 and 1326 ($S_1$ and $S_2$), all of which are embodied within a female connector housing. Red (R) color-control pin 1308 is coupled to red (R) color-control pin hole 1318 through a red (R) color-control line; green (G) color-control pin 1310 is coupled to green (G) color-control pin hole 1320 through a green (G) color-control line; blue (B) color-control pin 1312 is coupled to blue (B) color-control pin hole 1322 through a blue (B) color-control line; first LED set selection pin 1314 ($S_1$) is coupled to first LED set selection pin hole 1324 ($S_1$) through a first LED set selection line ($S_1$); and second LED set selection pin 1316 ($S_2$) is coupled to second LED set selection pin hole 1326 ($S_2$) through a second LED set selection line ($S_2$). All pins and pin holes are electrically conductive and may be referred to more generally as electrical contacts. In this embodiment, male and female connectors 1302 and 1304 are of the same construction as a conventional "PS2" interface; however any suitable construction may be utilized.

Along decorative light strand 1306 of FIG. 13, all color-controllable LEDs (not shown) have their red color-control terminals coupled to the red (R) color-control line, their green color-control terminals coupled to the green (G) color-control line, and their blue color-control terminals coupled to the blue (B) color-control line. Each LED set selection line may be coupled to a different set of color-controllable LEDs. Male connector 1302 may correspond to connector 130 in FIG. 1, so as to connect to a corresponding female connector on the control box. Female connector 1304 may be coupled to a male connector of an additional decorative light strand of the same type as decorative light strand 1306.

Figure 14:
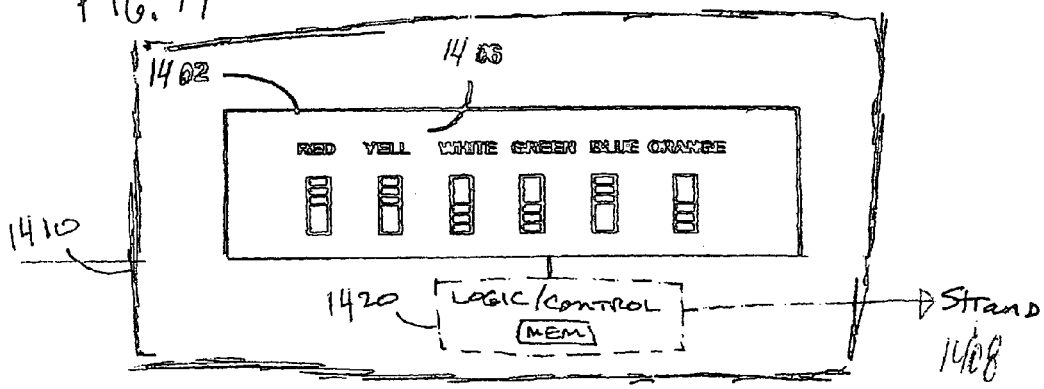
FIG. 14 is a dip switch which may be utilized as the decorating selector for selecting colors and color schemes in the color-controllable lights.

FIG. 14 is a different configuration for an alternative switch 1402 to be utilized as the decorating selector 104 of FIG. 1 for selecting colors in the lights. In this embodiment, switch 1402 is actually a dip switch which provides for the selection of specific colors to be turned on/off. A housing 1410 carries the dip switch, which is coupled to logic/control circuitry 1420. Logic/control circuitry 1420 includes memory and is carried within housing 1410. A color-controllable LED strand 1408 is coupled to logic/control circuitry 1420 and may be directly connected to housing 1406. An exposed switch portion 1406 on housing 1410 reveals settable color-control switches which include red, yellow, white, green, blue, and orange; however additional color switches associated with different colors may be provided. Color indicators are provided on a surface of housing 1410 as shown. In an alternative embodiment, switch 1402 is provided in a housing separate from housing 1410 but has a cable which is directly attached to it. The decorative lighting apparatus in this embodiment generally has a similar structure and functionality as that described in relation to FIGS. 1–13, where decorative outcomes similar to those described may be achieved utilizing a dip switch technique such that the end-user has complete control over each color.

Specifically, the memory of logic/control circuitry 1420 of FIG. 14 includes color data corresponding to each color that is associated with a color-control switch. Alternatively, the memory includes color scheme data corresponding to each setting combination of color-control switches in switch 1402. Logic/control circuitry 1420 is operative as follows. If only a first switch associated with a first color (e.g. red) is set by the end user, then logic/control circuitry 1420 identifies color data corresponding to red and controls all of the RGB LEDs to be illuminated with the color red along strand 1408 (e.g. $L_1$=red, $L_2$=red, $L_3$=red, $L_4$=red, repeat). If subsequently a second switch associated with a second color (e.g. white) is set by the end user, then logic/control circuitry 1420 identifies color data corresponding to white and controls the RGB LEDs to be illuminated in repeated interleaved sequence of red and white along strand 1408 (e.g. $L_1$=red, $L_2$=white, $L_3$=red, $L_4$=white, repeat). If subsequently a third switch associated with a third color (e.g. blue) is set by the end user, then logic/control circuitry 1420 identifies color data corresponding to blue and controls the RGB LEDs to be illuminated in repeated interleaved sequence of red, white, and blue along strand 1408 (e.g. $L_1$=red, $L_2$=white, $L_3$=blue, $L_4$=off, repeat). Light colors may be removed by the end user by unsetting the corresponding switch. Alternatively, or in addition to utilizing such a switch in FIG. 14, it may be desirable to utilize a plurality of user-selectable potentiometers as part of the switch to provide the end user with maximum control over the variety of colors illuminated in the color-controllable lights. In any case, for each one of all possible combinations of one or more user-selectable color-control switches which have been set, the control circuitry illuminates the RGB LEDs with a color scheme corresponding to the one or more user-selectable color-control switches.

Figure 15:
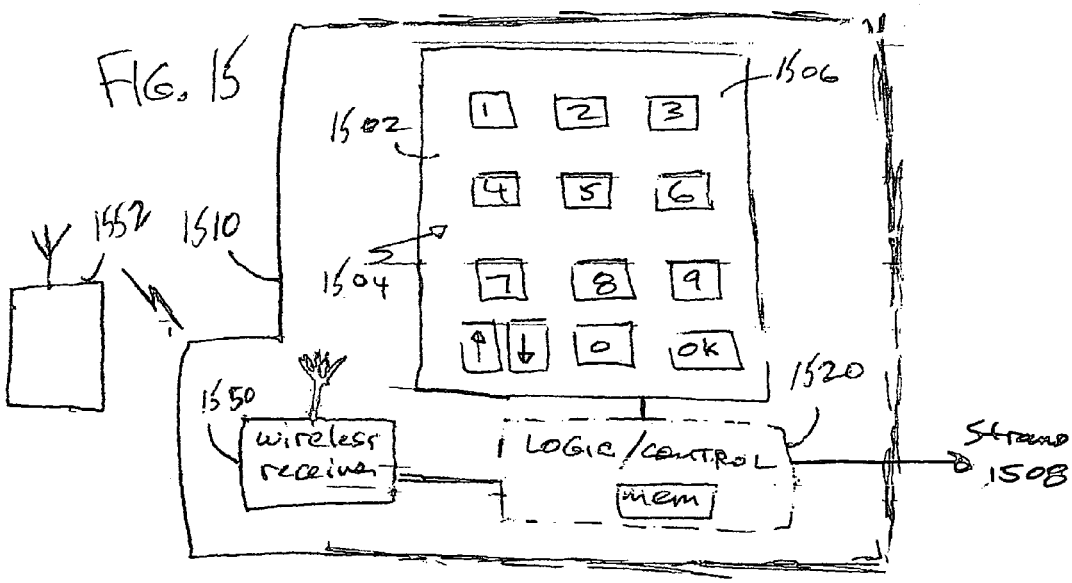
FIG. 15 is a keypad switch which may be utilized as the decorating selector for selecting color schemes in the color-controllable lights.

FIG. 15 is another alternative switch 1502 which may be alternatively utilized for the decorating selector 104 of FIG. 1. In this embodiment, switch 1502 is a keypad which provides for the selection of many preprogrammed holiday color schemes. A housing 1510 carries the keys of the keypad, which is coupled to logic/control circuitry 1520. Logic/control circuitry 1520 includes memory and is carried within housing 1510. A color-controllable LED strand 1508 is coupled to logic/control circuitry 1520 and may be directly connected to housing 1510. In an alternative embodiment, switch 1502 is provided in a housing separate from housing 1510 but has a cable which is directly attached to it. An exposed keypad portion 1506 on housing 1510 reveals user-settable switches which include one or more keys 1504 corresponding to 0 to 9, "OK", and scheme-select switches FORWARD and BACK.

If wireless remote switching is utilized, a wireless receiver 1550 is carried within housing 1510 and coupled to logic/control circuitry 1520 and the keypad is part of a wireless remote controller 1552 which is battery-operated. Provided as a separate unit, wireless remote controller 1552 with the keypad includes a wireless transmitter and a controller which is coupled to keypad inputs. The wireless technique may utilize well-known radio frequency (RF) or infrared communications, as examples. The wireless remote switching may be important to provide an end user with mobility and thus visibility uniquely suited for the very different color schemes which may be illuminated at an inconvenient location (e.g. outside of the end user's house or building). This wireless remote switching may be used in connection with decorating selectors/switches other than a keypad, for example, the wireless remote switching may be utilized with the decorating selectors/switches shown and described in relation to FIG. 1 or FIG. 14.

The decorative lighting apparatus using switch 1502 of FIG. 15 has a somewhat similar structure and functionality as that described in relation to FIGS. 1–13. The memory of logic/control circuitry 1520 includes a stored list of color scheme data. Each listing of color scheme data is associated with one of a plurality of user-selectable entries (e.g. numeric entries) from the keypad and includes color data. The color schemes may be alternatively controlled or set using the scheme-select FORWARD and BACK keys, which select forward or back from the current listing. Preferably, the user-selectable entries (e.g. the numeric entries) are printed in association with an indication or name of the associated color scheme, either on housing 1510 directly or on a separate instruction sheet. For example, the print may recite the following: 1=all white; 2=Valentines Day; 3=Easter; 4=Independence Day; 5=Cinco de Mayo; 6=Thanksgiving; 7=Mardi Gras; etc.

Preferably, the memory of the logic/control circuitry is configured to store data for all major U.S. holiday color schemes (such as those described herein) and at least a few more celebratory schemes. Even more preferably, the memory is configured to store preprogrammed data associated with at least ten (10) or at least twenty (20) different color schemes associated with various U.S. holidays, celebratory events, national flags, and sports teams, such as those described herein, with or without different effects such as flashing, fading, and/or movement. Most preferably, the memory is configured to store preprogrammed data associated with at least fifty (50) different schemes for various U.S. holidays, celebratory events, national flags, and sports teams, such as those described herein, with or without different effects such as flashing, fading, and/or movement.

Figure 16:
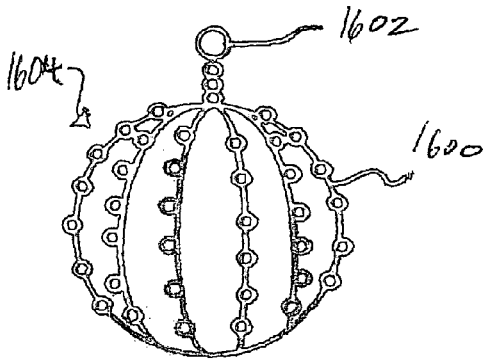
FIG. 16 is one example of an alternative decorative apparatus as a 3-dimensional structure (e.g. a decorative holiday ball).

FIG. 16 is an alternate embodiment of a decorative lighting apparatus. More particularly, FIG. 16 shows a decorative holiday ball 1600 which may be hung from a ceiling by an attachment 1602 (e.g., a chain or rope). In this embodiment, the decorative holiday ball 1600 is made from a skeletal structure of light-weight metal or plastic which is formed into a sphere. This sphere is decorated with the color-controllable lights (i.e. the LED nodes), and could be decorated with other decorative materials such as decorative paper, streamers, etc. Ball 1600 is configured to function in the same manner as that described in relation to FIGS. 1–15 and is selectively illuminated with a different color scheme based on the user-selectable setting. The sphere is just one example of a 3-dimensional structure which may be configured; other structures such as a block or a star may be made.

Also alternatively, the structure may be a 2-dimensional structure which is formed into a rectangle or circle.

Final Comments. As described herein, a decorative lighting apparatus provides user-selectable color schemes corresponding to several holidays and other occasions for year-round use. In one example of the present invention, the decorative lighting apparatus includes control circuitry which has a plurality of color-control outputs for coupling to color-control terminals of each one of a plurality of color-controllable lights along a decorative light strand. The control circuitry is operative to illuminate the color-controllable lights with any given color scheme by repeatedly time-multiplexing color-control signals at the color-control outputs to different interleaved sets of color-controllable lights along the decorative light strand. Preferably, the color-controllable lights include Red-Green-Blue (RGB) Light-Emitting Diodes (LEDs). Advantageously, the decorative light strand may be hung permanently and utilized year-round for major holidays and other suitable occasions. In a color-scheme-controllable light strand, the use of RGB LEDs as described provides for flexibility in the choice of colors through use of color setting and mixing techniques (e.g. pulse width modulation and/or current control), reduces the number of (or eliminates) non-lit bulbs for at least some color schemes, and provides the light strand with a long-life which is especially desirable in a year-round application. The time-multiplexed control over the color-controllable RGB LEDs as described reduces the number of wired lines to the lights, which is particularly advantageous in a decorative light strand.

Another example of a decorative lighting apparatus of the present invention is a decorative light strand which has a plurality of wires, a plurality of color-controllable lights positioned along the wires, and an interface connector coupled to a first end of the plurality of wires. The interface connector includes a first electrical contact coupled to red color-control terminals of the color-controllable lights; a second electrical contact coupled to green color-control terminals of the color-controllable lights; a third electrical contact coupled to blue color-control terminals of the color-controllable lights; and one or more fourth electrical contacts for use in selectively enabling different light sets of the color-controllable lights for color control. Preferably, the color-controllable lights include RGB LEDs.

A method of illuminating a decorative lighting apparatus with one or more color schemes may include the steps of selecting a first set of color-controllable lights along a decorative light strand; controlling a plurality of color-control outputs which are coupled to color-control terminals of the first set of color-controllable lights to illuminate a first color in the first set of color-controllable lights; selecting a second set of color-controllable lights along the decorative light strand; controlling the plurality of color-control outputs which are coupled to color-control terminals of the second set of color-controllable lights to illuminate a second color in the second set of color-controllable lights; and repeating the selecting and the controlling to produce a color scheme along the decorative light strand which includes the first color and the second color.

It is to be understood that the above is merely a description of preferred embodiments of the invention and that various changes, alterations, and variations may be made without departing from the true spirit and scope of the invention as set for in the appended claims. The several embodiments and variations described above can be combined with each other where suitable. The particular color schemes for the holidays described herein are merely examples and may vary. It is not necessary that the plurality of wires along the decorative light strand be intertwined or bound; they could be provided in a 2-dimensional matrix or 3-dimensional structure. Also, the lights in each set need not be interleaved with lights of another set or sets. Few if any of the terms or phrases in the specification and claims has been given any special particular meaning different from the plain language meaning, and therefore the specification is not to be used to define terms in an unduly narrow sense.

What is claimed is:

1. A decorative lighting apparatus, comprising: control circuitry;

a plurality of color-control outputs from the control circuitry for coupling to color-control terminals of each one of a plurality of color-controllable lights;

the color-control outputs including a red color-control output for coupling to each red color-control terminal of the color-controllable lights;

the color-control outputs including a green color-control output for coupling to each green color-control terminal of the color-controllable lights;

the color-control outputs including a blue color-control output for coupling to each blue color-control terminal of the color-controllable lights;

one or more set selection outputs from the control circuitry for selectively and individually enabling at least a first set of one or more of the color-controllable lights and a second set of one or more of the color-controllable lights; and the control circuitry being operative to illuminate the color-controllable lights with a color scheme by repeatedly time-multiplexing color-control signals at the red, the green, and the blue color-control outputs to the first and the second sets of color-controllable lights with use of the one or more set selection outputs at a rate of 32 Hertz or greater.

2. The decorative lighting apparatus of claim 1, wherein each color-controllable light comprises a Red-Green-Blue (RGB) Light-Emitting Diode (LED).

3. The decorative lighting apparatus of claim 1, further comprising:

the one or more set selection outputs from the control circuitry for selectively and individually enabling at least the first set, the second set, and a third set of one or more of the color-controllable lights; and the control circuitry being operative to illuminate the color-controllable lights with the color scheme by repeatedly time-multiplexing color-control signals at the red, the green, and the blue color-control outputs to the first, the second, and the third sets of color-controllable lights with use of the one or more set selection outputs at the rate of 32 Hertz or greater.

4. The decorative lighting apparatus of claim 1, further comprising:

a plurality of switch driver circuits including a first switch driver circuit, a second switch driver circuit, and third switch driver circuit; and wherein each one of the plurality of color-control outputs comprise a switch driver output from one of the switch driver circuits.

5. The decorative lighting apparatus of claim 1, further comprising:

the control circuitry being further operative to repeatedly time-multiplex the color-control signals at the color-control outputs at the rate of 32 Hertz or greater which is sufficient such that the different sets of color-controllable lights appear to be simultaneously illuminated.

6. The decorative lighting apparatus of claim 1, further comprising:

wherein the first set is controlled to be illuminated with the first color and the second set is controlled to be illuminated with the second color.

7. The decorative lighting apparatus of claim 1, further comprising:

the control circuitry being further operative to illuminate a color of the color scheme in the color-controllable lights with use of pulse-width modulation (PWM) and/or current control at the color-control outputs.

8. The decorative lighting apparatus of claim 1, further comprising:

a decorative light strand along which the color-controllable lights are carried.

9. The decorative lighting apparatus of claim 1, wherein the different sets of color-controllable lights are positioned in a linear fashion along a decorative light strand such that each color-controllable light of each set is interleaved between color-controllable lights of the other set or sets.

10. The decorative lighting apparatus of claim 1, further comprising:

a housing; and an interface connector attached to the housing which provides the plurality of color-control outputs for coupling to the color-control terminals of the color-controllable lights.

11. The decorative lighting apparatus of claim 1, further comprising:

a decorating selector which provides a plurality of user-selectable switch settings; and the control circuitry being further operative to illuminate the color-controllable lights with a different color scheme for each user selectable switch setting, by repeatedly time-multiplexing color-control signals at the color-control outputs to the first and the second sets of color-controllable lights at the rate of 32 Hertz or greater.

12. The decorative lighting apparatus of claim 1, wherein each color-controllable light comprises a Red-Green-Blue (RGB) Light-Emitting Diode (LED) having the red color-control terminal, the green color-control terminal, and the blue color-control terminal, the decorative lighting apparatus further comprising:

each set selection output for coupling to one of the first and the second sets of color-controllable lights through their common anodes or common cathodes;

a housing;

the control circuitry being carried in the housing;

a decorating selector which provides a plurality of user-selectable switch settings; and the control circuitry being further operative to illuminate the color-controllable lights with a different color scheme for each user selectable switch setting, by repeatedly time-multiplexing color-control signals at the color-control outputs to the first and the second sets of color-controllable lights at the rate of 32 Hertz or greater.

13. A method of illuminating a decorative lighting apparatus with one or more color schemes, comprising:

receiving a user switch setting of a plurality of user-selectable switch settings associated with a plurality of color schemes of the decorative lighting apparatus;

selecting the color scheme in response to the user switch setting;

producing the color scheme in the decorative lighting apparatus by:

selecting a first set of color-controllable lights of the decorative lighting apparatus;

controlling a plurality of red, green, and blue color-control outputs which are coupled to red, green, and blue color-control terminals, respectively, of the first set of color-controllable lights to illuminate a first color in the first set of color-controllable lights;

selecting a second set of color-controllable lights of the decorative lighting apparatus;

controlling the plurality of red, green, and blue color-control outputs which are coupled to red, green, and blue color-control terminals, respectively, of the second set of color-controllable lights to illuminate a second color in the second set of color-controllable lights; and repeating the selecting and the controlling, in a time-multiplexed fashion, to produce the color scheme which includes the first color and the second color.

14. The method of claim 13, wherein the color-controllable lights comprise color-controllable red-green-blue (RGB) light-emitting diodes (LEDs).

15. The method of claim 13, further comprising:

selecting a third set of color-controllable lights of the decorative lighting apparatus;

controlling the plurality of red, green, and blue color-control outputs which are coupled to red, green, and blue color-control terminals, respectively, of the third set of color-controllable lights to illuminate a third color in the third set of color-controllable lights; and repeating the selecting and the controlling to produce the color scheme in the decorative lighting apparatus which includes the first, the second, and the third colors.

16. The method of claim 13, wherein the first color is different from the second color.

17. The method of claim 13, wherein the first color is the same as the second color.

18. The method of claim 13, wherein the act of repeating is performed at rate sufficient such that the first and the second sets of color-controllable lights appear to be simultaneously illuminated.

19. The method of claim 13, wherein the decorative lighting apparatus comprises part of a decorative light strand which carries the color-controllable lights.

20. A decorative lighting apparatus, comprising:

a decorating selector which provides a plurality of user-selectable switch settings;

control circuitry;

a plurality of color-control outputs from the control circuitry for coupling to color-control terminals of each one of a plurality of color-controllable lights;

the color-control outputs including a red color-control output for coupling to each red color-control terminal of the color-controllable lights;

the color-control outputs including a green color-control output for coupling to each green color-control terminal of the color-controllable lights;

the color-control outputs including a blue color-control output for coupling to each blue color-control terminal of the color-controllable lights;

one or more set selection outputs from the control circuitry for selectively and individually enabling at least a first set of one or more of the color-controllable lights and a second set of one or more of the color-controllable lights; and the control circuitry being operative to illuminate the color-controllable lights with a different color scheme for each user-selectable switch setting by repeatedly time-multiplexing color-control signals at the red, the green, and the blue color-control outputs to the first and the second sets of color-controllable lights with use of the one or more set selection outputs.

21. The decorative lighting apparatus of claim 20, which is part of a decorative light stand which carries the plurality of color-controllable lights.

* * * * *